US009091992B2

(12) United States Patent
Tamura et al.

(10) Patent No.: US 9,091,992 B2
(45) Date of Patent: Jul. 28, 2015

(54) IMAGE FORMING APPARATUS, CONTROL METHOD FOR IMAGE FORMING APPARATUS, AND STORAGE MEDIUM

(71) Applicant: CANON KABUSHIKI KAISHA, Tokyo (JP)

(72) Inventors: Makiya Tamura, Tokyo (JP); Daijiro Miyamoto, Kawasaki (JP); Megumi Saito, Tokyo (JP); Tadanori Nakatsuka, Kawasaki (JP); Naoya Kakutani, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 47 days.

(21) Appl. No.: 13/875,815

(22) Filed: May 2, 2013

(65) Prior Publication Data

US 2013/0294795 A1 Nov. 7, 2013

(30) Foreign Application Priority Data

May 7, 2012 (JP) ..... 2012-105609
May 7, 2012 (JP) ..... 2012-105610

(51) Int. Cl.
*G03G 15/00* (2006.01)
*G03G 15/23* (2006.01)

(52) U.S. Cl.
CPC ..... *G03G 15/6555* (2013.01); *G03G 15/234* (2013.01); *G03G 15/5062* (2013.01); *G03G 15/6573* (2013.01)

(58) Field of Classification Search
CPC ..... G03G 15/6555; G03G 15/234; G03G 15/5062; G03G 15/6573
USPC ..... 399/82–85
See application file for complete search history.

(56) References Cited

U.S. PATENT DOCUMENTS

| | | | | |
|---|---|---|---|---|
| 5,923,360 | A * | 7/1999 | Mori | 347/262 |
| 7,248,809 | B2 * | 7/2007 | Kim et al. | 399/81 |
| 7,869,069 | B2 * | 1/2011 | Currans et al. | 358/1.15 |
| 2013/0292898 | A1 * | 11/2013 | Miyamoto et al. | 271/227 |
| 2013/0293912 | A1 * | 11/2013 | Saito | 358/1.13 |
| 2014/0139886 | A1 * | 5/2014 | Nakatsuka | 358/3.24 |

FOREIGN PATENT DOCUMENTS

JP 2000-185881 A 7/2000

* cited by examiner

*Primary Examiner* — Rodney Bonnette
(74) *Attorney, Agent, or Firm* — Canon USA Inc IP Division

(57) ABSTRACT

An image forming apparatus, in a case where a print setting for printing an image on a preprinted surface of a preprinted sheet has been set and a surface of the sheet read by a reading unit is a preprinted surface, executes printing on the sheet. The image forming apparatus, in a case where a print setting for printing an image on an unprinted surface of a preprinted sheet has been set and a surface of the sheet read by the reading unit is not a preprinted surface, executes printing on the sheet.

12 Claims, 18 Drawing Sheets

IMAGE FORMING APPARATUS, CONTROL METHOD FOR IMAGE FORMING APPARATUS, AND STORAGE MEDIUM

BACKGROUND OF THE INVENTION

1. Field of the Invention

The present application relates to an image forming apparatus that prints an image on a preprinted sheet, a control method for the image forming apparatus, and a storage medium.

2. Description of the Related Art

In an image forming apparatus discussed in Japanese Patent Application Laid-Open No. 2000-185881, an image reading unit is mounted in a transfer-paper conveyance path routed from a sheet feeding unit to a sheet discharge unit, so that a document conveyance system and a transfer-paper conveyance system are in shared use.

In the image forming apparatus as described above, before printing by a printing unit on a document in the sheet feeding unit, the document in the sheet feeding unit is read by the reading unit to acquire image data of the document, and, subsequently, printing on the document in the sheet feeding can be performed.

On the other hand, in such image forming apparatuses, some apparatuses have a paper conveyance path or a printing unit that enables printing in an overlay manner on a document of which one side or two sides of the document were preprinted. As such use application, overwrite printing for printing in an overlay manner on a document in which a prescribed form was already printed, or back surface printing for printing on an unprinted surface of a document in which only one side was printed, is conceivable.

In the case of performing such print processing, a document of which one side or two sides were preprinted is placed in the sheet feeding unit before a user executes print processing, and the image forming apparatus receives a print job (print data) transmitted from an information processing apparatus such as a personal computer (PC), so that overwrite printing or back surface printing is executed.

However, when the user transmits a print job from the information processing apparatus, in a case where it is unknown what document is placed in the sheet feeding unit of an image forming apparatus at a transmission destination, printing may be performed in some cases on an unintended surface of the document. For example, when overwrite printing is performed on a document on which a prescribed form was already been printed, in a case where the document having the printed prescribed form is placed with the front surface facing down and the back surface facing up in the sheet feeding unit, or in a case where white paper is placed in the sheet feeding unit, print processing may be performed on a surface that does not have the printed prescribed form. Alternatively, when printing on an unprinted surface of a document of which only one side was preprinted is performed, in a case where the document of which only one side was preprinted is placed with the front surface facing down and the back surface facing up in the sheet feeding unit, or in a case where a document of which two sides were preprinted is placed in the sheet feeding unit, print processing may be performed on a surface that is not white paper. This may cause a print result unexpected by the user. In this case, the user may take a time and labor such as reversing the surface of the sheet and re-setting the sheet in the sheet feeding unit, and sheets may be wasted due to erroneous printing.

SUMMARY OF THE INVENTION

The present disclosure is directed to an image forming apparatus, when performing printing on a preprinted sheet, capable of performing printing on a printed surface of the sheet. Further, the present invention is directed to an image forming apparatus, when performing printing on a preprinted sheet, capable of performing printing on an unprinted surface of the sheet.

According to an aspect of the present disclosure, an image forming apparatus includes a sheet storage unit configured to store a sheet, a conveyance unit configured to convey the sheet using a two-sided conveyance path used for two-sided printing, a printing unit configured to print an image on the sheet, a setting unit configured to set a print setting for printing an image on a preprinted surface of a preprinted sheet conveyed from the sheet storage unit, a reading unit configured to read a surface of the sheet conveyed using the two-sided conveyance path, a determination unit configured to determine whether the surface read by the reading unit is a preprinted surface, a print control unit configured, in a case where the print setting has been set and if it is determined that the surface read by the reading unit is a preprinted surface, to execute printing on the sheet conveyed using the two-sided conveyance path, and in a case where the print setting has been set and if it is determined that the surface read by the reading unit is not a preprinted surface, to restrict printing on the sheet conveyed using the two-sided conveyance path.

According to another aspect of the present disclosure, an image forming apparatus includes a sheet storage unit configured to store a sheet, a printing unit configured to print an image on the sheet, a setting unit configured to set a print setting for printing an image on a preprinted surface of a preprinted sheet conveyed from the sheet storage unit, a reading unit configured to read a surface of the sheet conveyed from the sheet storage unit, and a control unit configured, in a case where the print mode has been set and if the surface read by the reading unit is a preprinted surface, to execute printing on the sheet.

According to yet another aspect of the present disclosure, an image forming apparatus includes a sheet storage unit configured to store a sheet, a conveyance unit configured to convey the sheet using a two-sided conveyance path used for two-sided printing, a printing unit configured to print an image on the sheet, a setting unit configured to set a print setting for printing an image on an unprinted surface of a preprinted sheet conveyed from the sheet storage unit, a reading unit configured to read a surface of the sheet conveyed using the two-sided conveyance path, a determination unit configured to determine whether the surface read by the reading unit is a preprinted surface, a print control unit configured, in a case where the print setting has been set and if it is determined that the surface read by the reading unit is a preprinted surface, to restrict printing on the sheet conveyed using the two-sided conveyance path, and in a case where the print setting has been set and if it is determined that the surface read by the reading unit is not a preprinted surface, to execute printing on the sheet conveyed using the two-sided conveyance path.

According to yet another aspect of the present disclosure, an image forming apparatus includes a sheet storage unit configured to store a sheet, a printing unit configured to print an image on the sheet, a setting unit configured to set a print setting for printing an image on an unprinted surface of a preprinted sheet conveyed from the sheet storage unit, a reading unit configured to read a surface of the sheet conveyed from the sheet storage unit, and a print control unit configured, in a case where the print setting has been set and if the surface read by the reading unit is not a preprinted surface, to execute printing on the sheet.

Further features and aspects of the present application will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
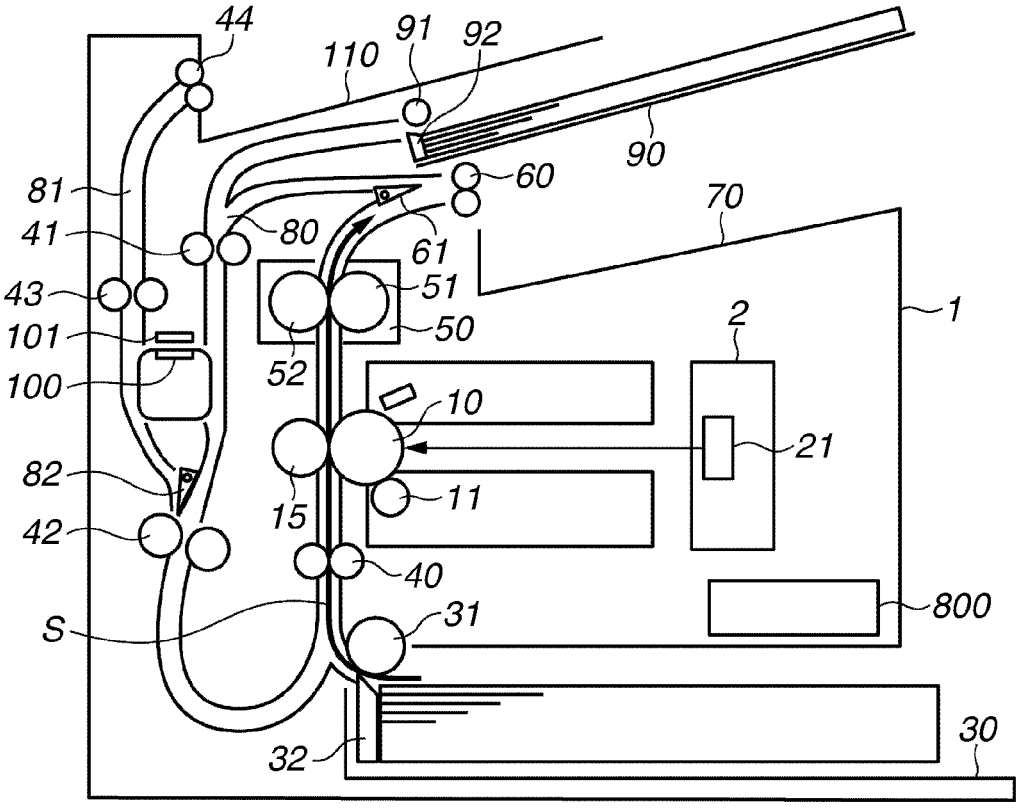
FIG. 1 is a cross-sectional view illustrating a configuration of an image forming apparatus according to an exemplary embodiment.

FIG. 1 is a cross-sectional view illustrating a configuration of an image forming apparatus according to an exemplary embodiment as disclosed herein. An image formation process will be described below. The example illustrates an example of an image forming apparatus provided with multi-functions. In the image forming apparatus according to the present exemplary embodiment, paper which is fed from a first sheet feeding unit or a second sheet feeding unit described below is called a sheet, and paper which is fed from the second sheet feeding unit and is not used for printing is called a document, thereby differentiating the one from the other. However, the second sheet feeding unit can also feed paper used for printing.

In FIG. 1, in the middle of an image forming apparatus 1, there are arranged a rotatable photosensitive drum 10, serving as an image bearing member, and a developing roller 11, which is juxtaposed to the photosensitive drum 10 and rotates while retaining toner. Upon receiving a print signal, a light-emitting unit 21, with which an optical unit 2 is equipped, irradiates a laser beam on the surface of the photosensitive drum 10, which is rotating. On the surface of the photosensitive drum 10 irradiated with the laser beam, a latent image is formed by an electric charge. When the developing roller 11, while rotating, supplies the retained toner to a latent image on the surface of the photosensitive drum 10, a toner image is formed on the surface of the photosensitive drum 10.

On the other hand, sheets (recording materials S) stored in the first sheet feeding unit 30 are conveyed one by one to a conveyance roller pair 40 by a cassette-tray (CST) pickup roller 31 and a separation unit 32. The conveyance roller pair 40 conveys the recording material S to a transfer unit 15 so as to synchronize timing of the toner image on the surface of the photosensitive drum 10 with a leading edge position of the recording material S. In the first sheet feeding unit 30, preprinted sheets can be stored in order to newly feed them. Further, a surface which is to be firstly printed, in a sheet, is called a first surface, and a surface which is to be printed after the sheet has been re-fed for reverse processing is called a second surface. Further, as a matter of course, sheets of which the first surface and the second surface are not preprinted can be stored in the first sheet feeding unit 30. Furthermore, a conveyance path leading from the first sheet feeding unit 30 to a two-sided flapper (diverter) 61 is called a one-sided conveyance path in terms of description, and the one-sided conveyance path is used when sheets are conveyed without executing two-sided printing.

The toner image conveyed to the transfer unit 15 by rotation of the photosensitive drum 10 is transferred onto the recording material S by an applied bias and pressure exerted to the transfer unit 15. Furthermore, the transfer unit 15 conveys the recording material S to a fixing unit 50. In the fixing unit 50, heat from a rotatable heating roller 51 and pressure of a rotatable pressure roller 52 located opposite the heating roller 51 helps to fix the toner image onto the recording material S. The recording material S on which the toner image has been fixed is conveyed to a sheet discharge roller 60. In the case of one-sided printing, the sheet discharge roller 60 directly conveys the recording material S to the outside of the apparatus, and the recording material S is stacked in a first sheet discharge unit 70.

Figure 8:
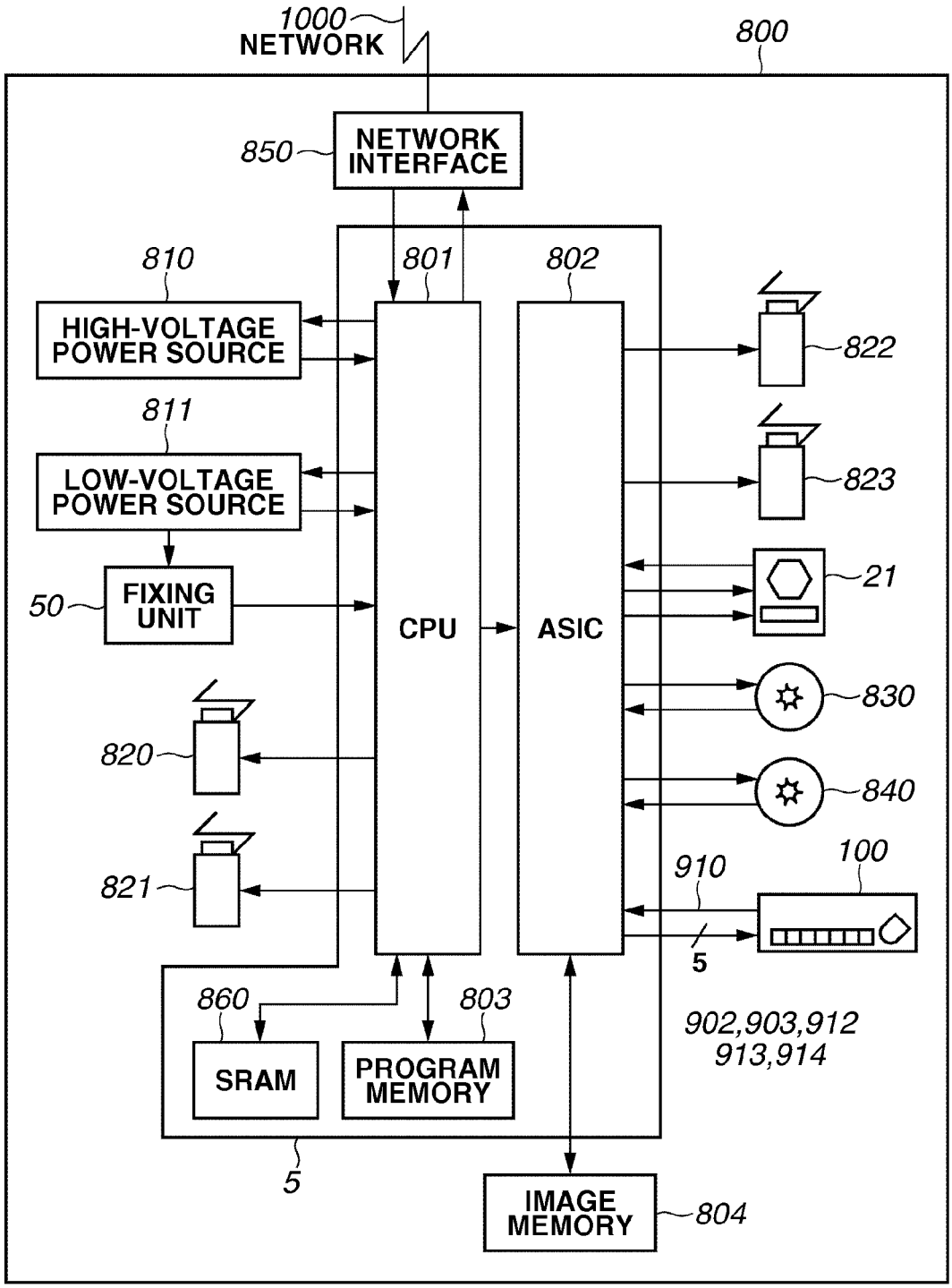
FIG. 8 is a block diagram illustrating a control configuration of the image forming apparatus.

Further, components of the image forming apparatus 1 are controlled by a controller 800 illustrated in FIG. 8.

Figure 2:
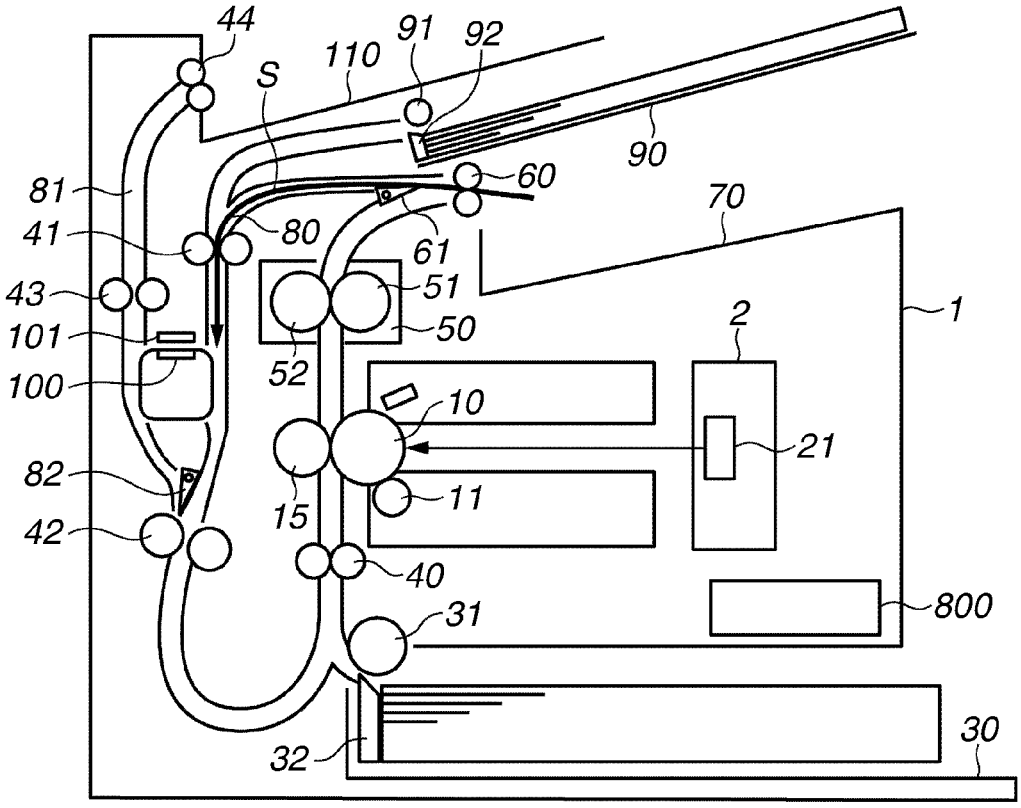
FIG. 2 illustrates a two-sided printing process by the image forming apparatus according to an exemplary embodiment.

FIG. 2 illustrates a two-sided printing process by the image forming apparatus according to the present exemplary embodiment. In FIG. 2, the two-sided flapper 61 switches a conveyance path after the trailing edge of the recording material S has passed therethrough. Thereafter, the sheet discharge roller 60 reversely rotates, and conveys the recording material S to a two-sided conveyance path 80. The recording material S, which has been switched to move back, is conveyed to the image reading unit 100 via a conveyance roller pair 41. Thereafter, the recording material S is conveyed to a conveyance roller pair 42 and the conveyance roller pair 40, again conveyed to the transfer unit 15, and then stacked in the first sheet discharge unit 70 after transfer and fixation of the toner image.

Processes for executing reading of image information from a document and two-sided printing on a recording material will be described below.

Figure 3:
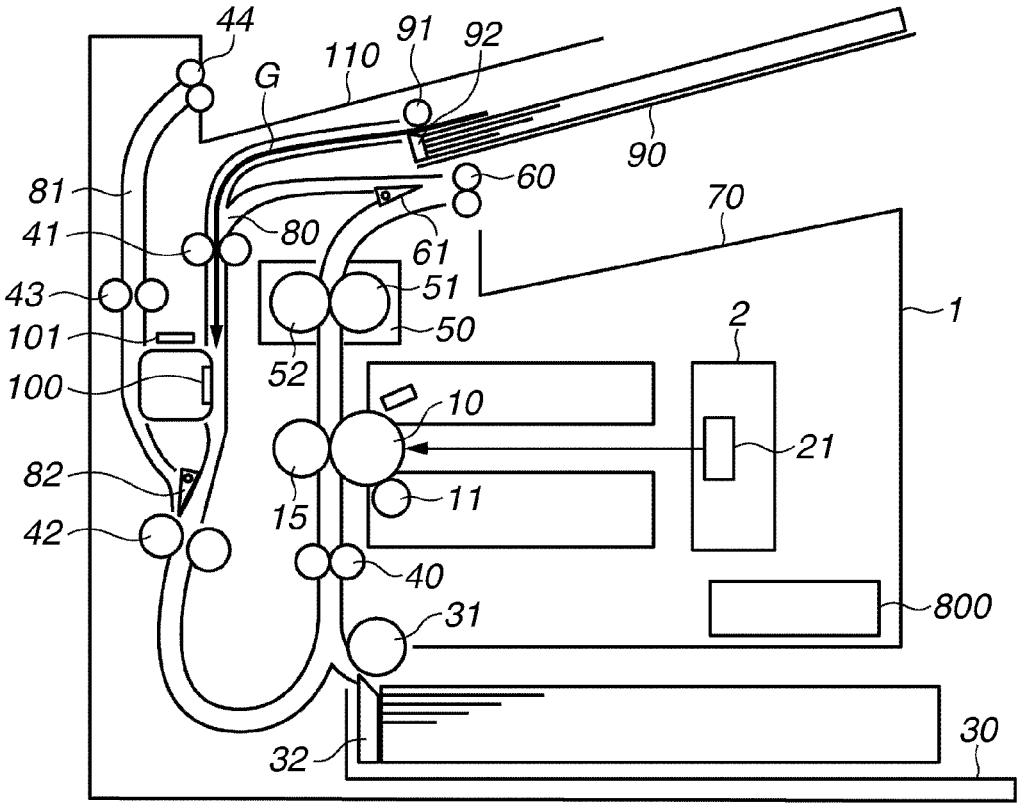
FIG. 3 illustrates a state at the start of reading a document front surface in the image forming apparatus according to an exemplary embodiment.

FIG. 3 illustrates a state at the start of reading a document front surface in the image forming apparatus according to the present exemplary embodiment. In FIG. 3, a document G stored in a second sheet feeding unit 90 is conveyed one sheet by one sheet to the conveyance roller pair 41 by a contact image sensor (CIS) pickup roller 91 and a separation unit 92. In this case, the second sheet feeding unit 90 also acts as a document sheet feeding unit, and the surface of the document fed from the second sheet feeding unit 90 or the surface of a sheet used for printing is read by an image reading unit 100. In other words, the image reading unit 100 is configured to be able to read the surface of a sheet fed from the first sheet feeding unit 30 and the surface of a document or sheet fed from the second sheet feeding unit 90.

On the other hand, the image reading unit 100 executes light emission to a white reference member 101 and correction of white reference values prior to the start of reading of the first surface as a document front surface of the document G fed from the second sheet feeding unit 90. Thereafter, the image reading unit 100 is driven by a driving unit to be rotated to and stopped at a position at which it faces the two-sided conveyance path 80. The conveyance roller pair 41 conveys the document G to the image reading unit 100. The image reading unit 100 already stands by at a position at which it faces the two-sided conveyance path 80, and information read by the image reading unit 100 is stored, as information of the document first surface, in an image memory 804. The details of the image memory 804 are described in FIG. 8. The white reference member 101 is arranged face-down in consideration of adhesion of dirt or dust is made.

Figure 4:
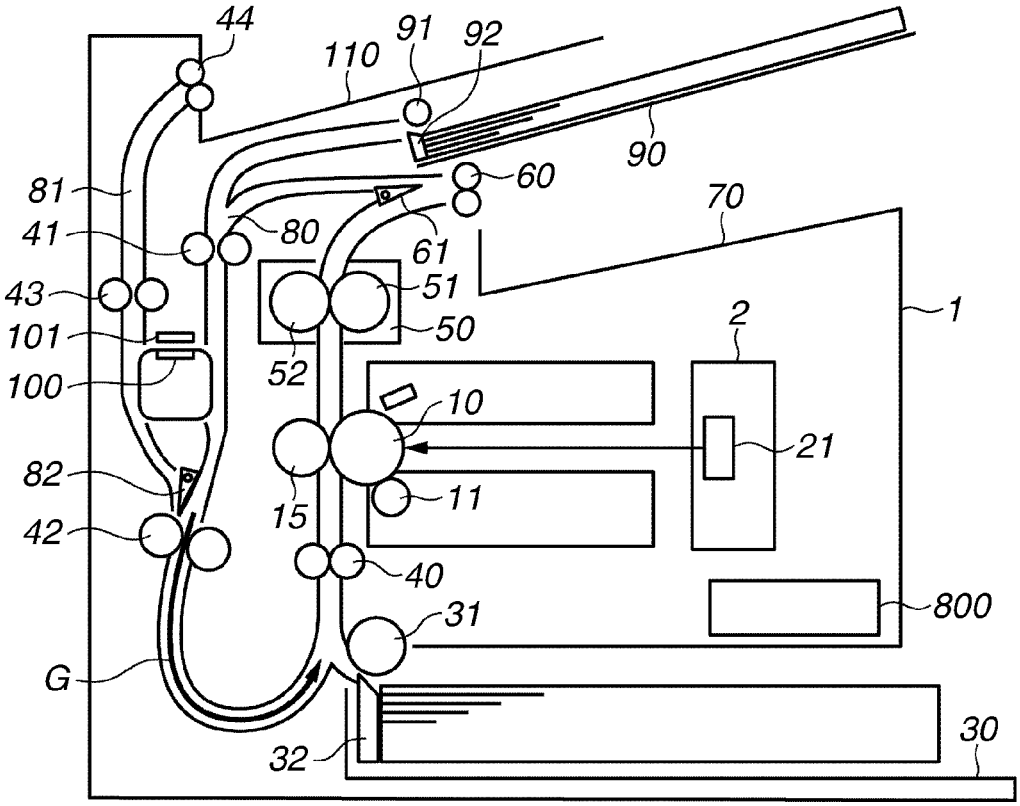
FIG. 4 illustrates a state at the end of reading a first surface as a document front surface in the image forming apparatus.

FIG. 4 illustrates a state at the end of reading the first surface, which is a document front surface, in the image forming apparatus according to the present exemplary embodiment.

In FIG. 4, the document G, which has passed through the image reading unit 100, is conveyed to the conveyance roller pair 42. The conveyance roller pair 42 stops at a time point when the trailing edge of the document G has passed through a switchback flapper 82. Therefore, the document G stops while being nipped between the conveyance roller pair 42. Then, the document G is conveyed to a document-only conveyance path 81 after a predetermined time has elapsed.

Figure 5:
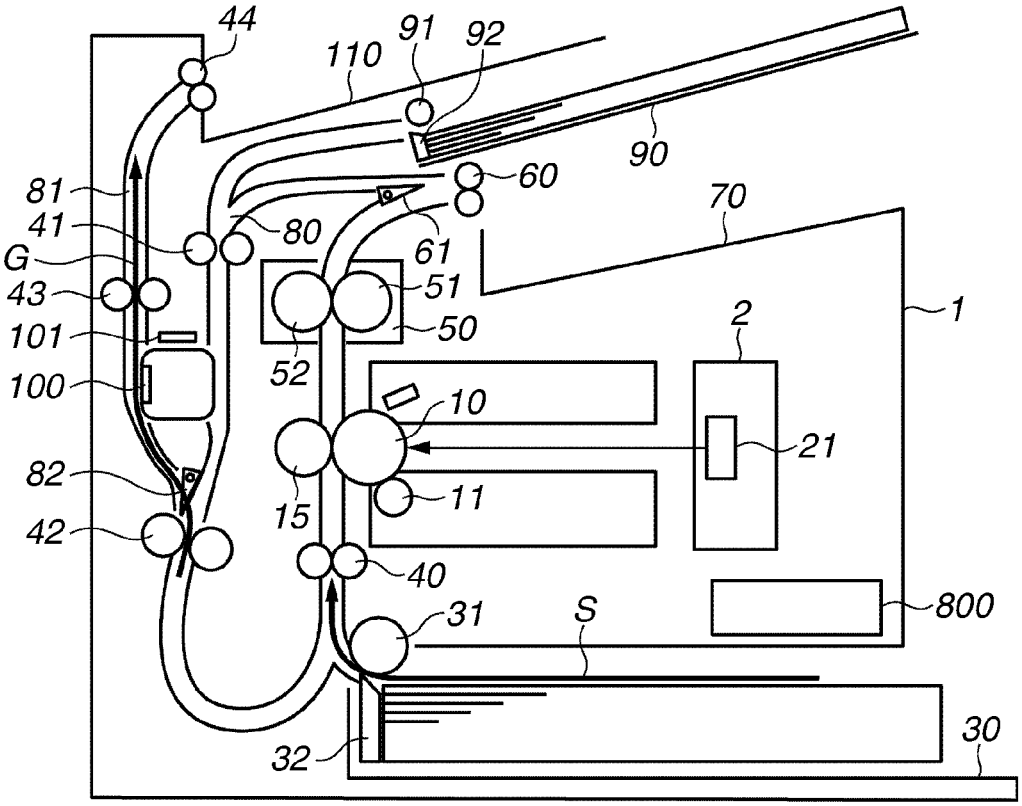
FIG. 5 illustrates a state at the start of reading a second surface as a document back surface in the image forming apparatus.

FIG. 5 illustrates a state at the start of reading the second surface, which is a document back surface, in the image forming apparatus according to the present exemplary embodiment.

In FIG. 5, the switchback flapper 82 switches a conveyance path from the two-sided conveyance path 80 to the document-only conveyance path 81, and at the same time the image reading unit 100 rotates to a position at which it faces the document-only conveyance path 81. When the conveyance roller pair 42 reversely rotates, the document G is conveyed to the image reading unit 100 along the document-only conveyance path 81. The image reading unit 100 is positioned such that its reading position is controlled according to a reading mode by the CPU 801.

The document G is conveyed and passes through the image reading unit 100, and thereby information of the second surface, which is a document back surface, is read and stored in the image memory 804 as information of the document second surface. The recording material S fed from the first sheet feeding unit 30 is conveyed one sheet by one sheet to the conveyance roller pair 40. Based on information of the second surface, which is a document back surface, stored almost simultaneously in the image memory 804, a latent image on the photosensitive drum 10 based on the previous image information is formed from the light-emitting unit 21. Next, after the toner image formed with the latent image has been transferred by the transfer unit 15, the recording material S is conveyed to the fixing unit 50, and image formation of the document second surface is completed.

In FIG. 5, although sheet feeding of the recording material S is started along with the start of reading information of the second surface, which is a document back surface, the recording material S may be conveyed after reading of information of the second surface.

Figure 6:
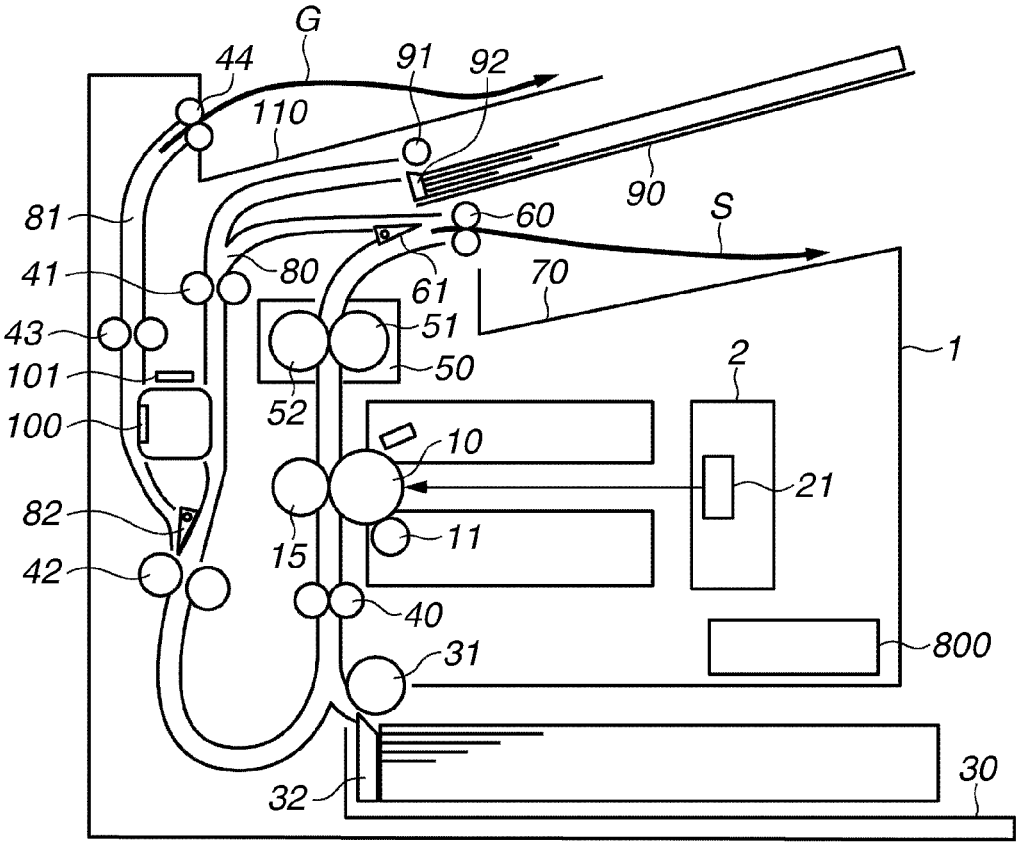
FIG. 6 illustrates a state at the end of reading a document back surface in the image forming apparatus.

FIG. 6 illustrates a state at the end of reading a document back surface in the image forming apparatus according to the present exemplary embodiment.

In FIG. 6, the document G, for which the image reading is finished, is conveyed to the conveyance roller pair 43 and the conveyance roller 44, and is stacked in a second sheet discharge unit 110. The switchback flapper 82, when the trailing edge of the document G passes therethrough, switches a conveyance path from the document-only conveyance path 81 to the two-sided conveyance path 80, so that the recording material S is conveyed toward the conveyance roller pair 40. The recording material S, for which the image formation of the document second surface is completed, is conveyed toward the two-sided conveyance path 80 switched by the two-sided flapper 61 by reverse rotation of the sheet discharge roller 60.

Figure 7:
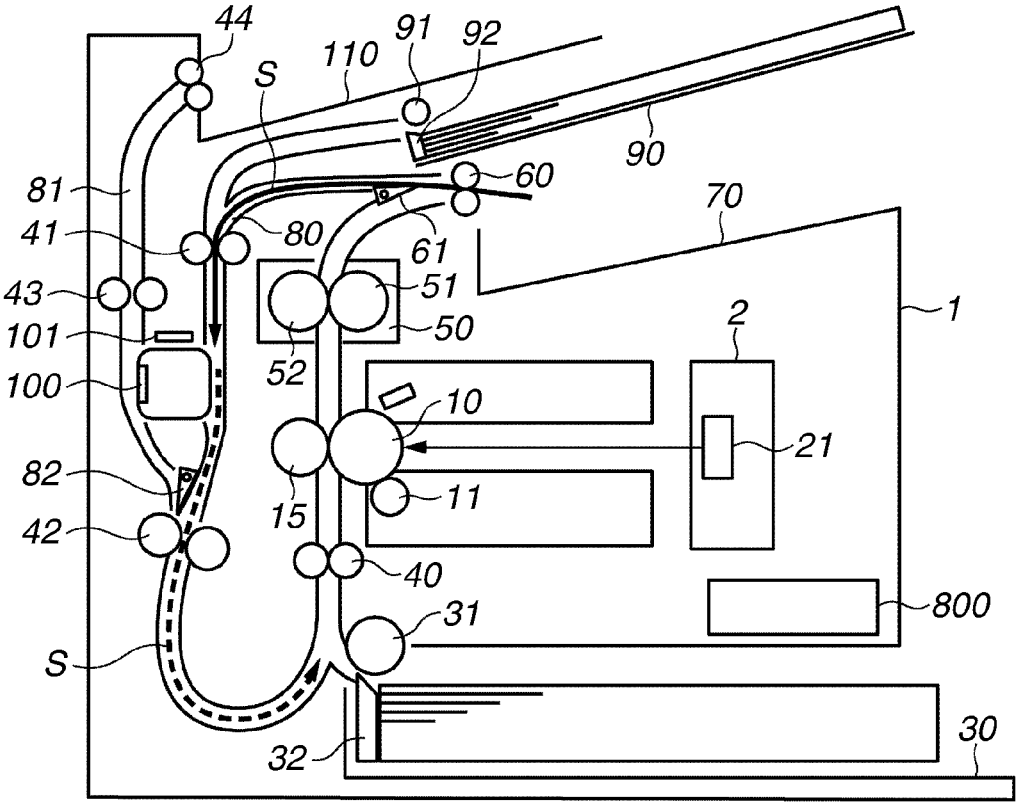
FIG. 7 illustrates a state where image formation onto a recording material is completed in the image forming apparatus.

FIG. 7 illustrates a state where image formation on the recording material S is completed in the image forming apparatus according to the present exemplary embodiment.

In FIG. 7, the recording material (sheet) S, which has been conveyed to the two-sided conveyance path 80, passes through the image reading unit 100, which has been reversed, and is conveyed to the conveyance roller pair 40 via the conveyance roller pair 42, and further conveyed again to the transfer unit 15 as viewed in the recording material S indicated by dashed line. On the recording material S, image formation of the document second surface is already finished. Thus, based on the previous image information of the document first surface stored in the image memory 804, an image of the document first surface is subjected to transfer processing and fixing processing of the toner image using the optical unit 2, the photosensitive drum 10, the developing roller 11, the transfer unit 15, and the fixing unit 50. Thereafter, the sheet is stacked in the first sheet discharge unit 70.

FIG. 8 is a block diagram illustrating a control configuration of the image forming apparatus according to the present exemplary embodiment. Hereinbelow, an operation of peripheral units of a CPU 801 serving as a control unit of the image forming apparatus 1 and an operation of application specific integrated circuits (ASIC) 802 will be described. Hereinbelow, a configuration of the controller 800 illustrated in FIG. 1 and the like will be described.

In FIG. 8, the CPU 801 is connected to the light-emitting unit 21, including a polygon mirror, a motor, and a laser light-emitting element, via the ASIC 802. This is for the purpose of performing control of the optical unit 2 by outputting a control signal to the ASIC 802, in order to draw a desired latent image by scanning a laser beam onto the surface of the photosensitive drum 10.

Similarly, the CPU 801 controls a main motor 830 for driving the CST pickup roller 31, the conveyance roller pair 40, the photosensitive drum 10, the transfer unit 15, the heating roller 51, and the pressure roller 52 in order to convey the recording material S. Furthermore, the CPU 801 controls a CST paper feed solenoid 822 for turning on at the start of driving the sheet feeding rollers that feed the recording material S and driving the CST pickup roller 31. Furthermore, the CPU 801 controls a driving system, such as a two-sided motor 840 for driving the CIS pickup roller 91 and the conveyance roller pairs 41 and 44.

Furthermore, the CPU 801 controls a high-voltage power source 810, the fixing unit 50, and a low-voltage power source 811, which control primary charge, development, primary transfer, and secondary transfer bias required for electrophotographic process. Furthermore, the CPU 801 monitors temperatures by a thermistor (not illustrated) provided in the fixing unit 50, and performs control to maintain a steady fixing temperature.

Further, the CPU 801 is connected to a program memory 803 via a bus (not illustrated) or the like. In the program memory 803, there are stored programs and data for executing all or a part of processing which the CPU 801 performs in the above control operations and respective exemplary embodiments described in the specification. In other words, the CPU 801 executes operations of the respective exemplary embodiments using the programs and data stored in the program memory 803.

The ASIC 802 performs motor speed control inside the light-emitting unit 21, and speed control of the main motor 830 and the two-sided motor 840 based on an instruction of the CPU 801. The speed control of a motor is performed by detecting a time-to-amplitude converter (TAC) signal (pulse signal output from a motor each time the motor is rotated) from a motor (not illustrated), and outputting an acceleration or deceleration signal to the motor so that the interval of the TAC signals becomes equal to a predetermined time.

In this way, the controller 800 has an advantage in that a reduction of control loads of the CPU 801 can be achieved, if it is configured with a circuit by hardware of the ASIC 802.

Upon receiving a print command instructed from a host computer (not illustrated), the CPU 801 drives the main motor 830, the two-sided motor 840, and the CST paper feed solenoid 822 to convey the recording material S.

After a toner image formed on the photosensitive drum 10 surface has been transferred by the transfer unit 15 and the toner image has been fixed by the fixing unit 50, the recording material S is discharged to the first sheet discharge unit 70, serving as a recording material stacking unit, by the sheet discharge roller 60. In order to improve alignment of image-formed recording material, the first sheet discharge unit 70 is provided with a gentle rising slope from near a sheet discharge port toward the recording material discharging direction. In this process, the CPU 801 causes a desired heat quantity to be generated and exerted to the recording material S by supplying a predetermined electric power via the low-voltage power source 811 to the fixing unit 50, and causes the toner image on the recording material to be fused and fixed.

Next, a document reading operation in the image forming apparatus 1 according to the present exemplary embodiment will be described.

Upon receiving a scan command instructed from the host computer (not illustrated), the CPU 801 drives a two-sided flapper solenoid 820 and the two-sided motor 840 to operate the CIS paper feed solenoid 822. Accordingly, a torque of the two-sided motor 840 is transmitted to the CIS pickup roller 91 to convey the document G. Further, the image reading unit 100 is connected to the ASIC 802 via CISLED, CISSTART, SYSCLK, SI_in, SI_select, SI_out as various types of control signals described below. The CPU 801 stores images, read from the image reading unit 100 by various types of control operations via the ASIC 802, in the image memory 804 connected the ASIC 802.

Thereafter, the CPU 801 operates a switchback solenoid 821, tilts the switchback flapper 82 toward the document-only conveyance path side, reverses the two-sided motor 840, and conveys the document G to the second sheet discharge unit 110.

Next, a communication operation in the image forming apparatus according to the present exemplary embodiment will be described.

The CPU 801 communicates with the host computer (not illustrated) or the like by connecting to a network 1000 via a network interface 850, and performs input and output of image information or device information.

Figure 9:
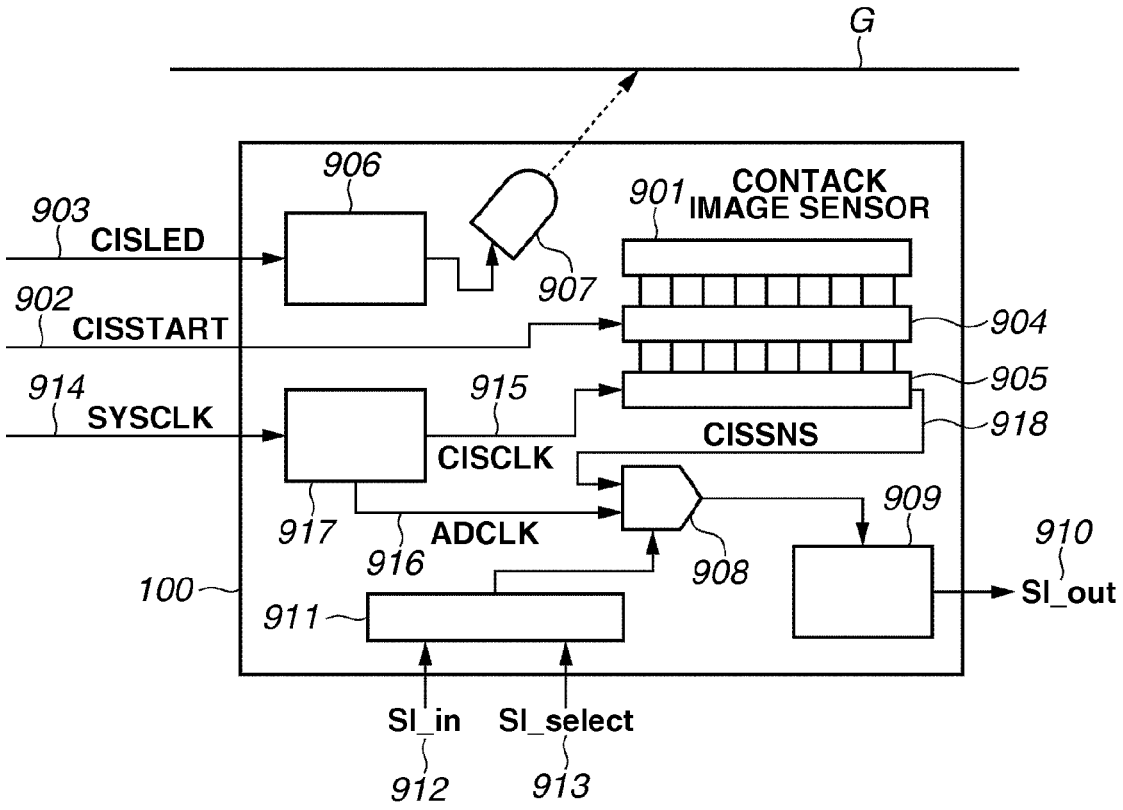
FIG. 9 is a diagram illustrating a configuration of a document reading unit illustrated in FIG. 1.

FIG. 9 illustrates a configuration of the document reading unit illustrated in FIG. 1. As an image sensor, in the present exemplary embodiment, an example of using the contact image sensor (CIS) is illustrated.

In FIG. 9, in a contact image sensor (CIS) portion 901, for example, photodiodes for 10,368 pixels are arranged in an array shape with a specific main-scanning density (for example, at 1200 dpi). A CISSTART signal 902 is a start pulse applied to the CIS sensor. A CISCLK 915 is a transfer clock. An SYSCLK 914 is a system clock that determines an operation speed of the CIS sensor unit. An ADCLK 916 is a CIS sampling clock which determines the sampling speed of an A/D converter 908. Further, the document reading unit 100 includes a timing generator 917, an output buffer 904, a shift register 905, a light-emitting element control signal (CISLED) 903, and a current amplification unit 906. A light-emitting element 907 uniformly irradiates the document G. Hereinbelow, operations of respective components will be described.

When the CISSTART signal 902 is made active, the CIS sensor unit 901 starts accumulation of electric charges based on light received, and sequentially sets up data in the output buffer 904.

Next, when the transfer clock CISCLK 915 (e.g., in the order of 500 kHz to 1 MHz) is applied, the data set up in the output buffer 904 is transferred to the A/D converter 908, as a CISSNS signal 918, by the shift register 905.

Since there is a predetermined data assurance region in the CISSNS signal 918, it is necessary to perform sampling after a predetermined time has elapsed from a rising timing of the transfer clock CISCLK 915. Further, the CISSNS signal 918 is output in synchronization with both rising and falling edges of the transfer clock CISCLK 915.

Consequently, the frequency of the CIS sampling clock ADCLK 916 is generated to become twice the frequency of the transfer clock the CISCLK 915, and the CISSNS signal 918 is sampled at a rising edge of the CIS sampling clock ADCLK 916. The timing generator 917 divides the frequency of the system clock SYSCLK 914 to generate the CIS sampling clock ADCLK 916 and the transfer clock CISCLK 915. A phase of the CIS sampling clock ADCLK 916 is delayed by a portion equivalent to the data assurance region, as compared with the transfer clock CISCLK 915.

The CISSNS signal 918 digitally converted by the A/D converter 908 is controlled by an output interface circuit 909 at a predetermined timing, and is output as serial data to an SI_out signal 910. At that time, an analog output reference voltage is output from the start pulse CISSTART 902 to the CISSNS signal 918 equivalent to predetermined pixels, which cannot be used as valid pixels.

On the other hand, an A/D conversion gain of the A/D converter 908 can be variably controlled according to an Sl_in signal 912 and an Sl_select signal 913 by a control circuit 911.

For example, in a case where a contrast of captured video is not obtained, the CPU 801 increases the contrast by increasing the A/D conversion gain of the A/D converter 908, and thereby video can be captured with the best contrast.

Herein, descriptions have been performed in a system in which all pixels are output as one piece of the CISSNS signal 918, but pixels may be divided for each area for the purpose of high-speed reading, and a plurality of areas may be simultaneously undergoes analog-to-digital (A/D) conversion. Further, although descriptions have been performed so far using the CIS sensor for the image reading unit 100, it goes without saying that the CIS sensor can be replaced by a complementary metal-oxide semiconductor (CMOS) sensor or a charge-coupled device (CCD) sensor.

Next, in the present exemplary embodiment, processing for transmitting a print job from a printer driver of the information processing apparatus to the image forming apparatus will be described with reference to FIG. 10, FIG. 11, and FIG. 12.

Figure 10:
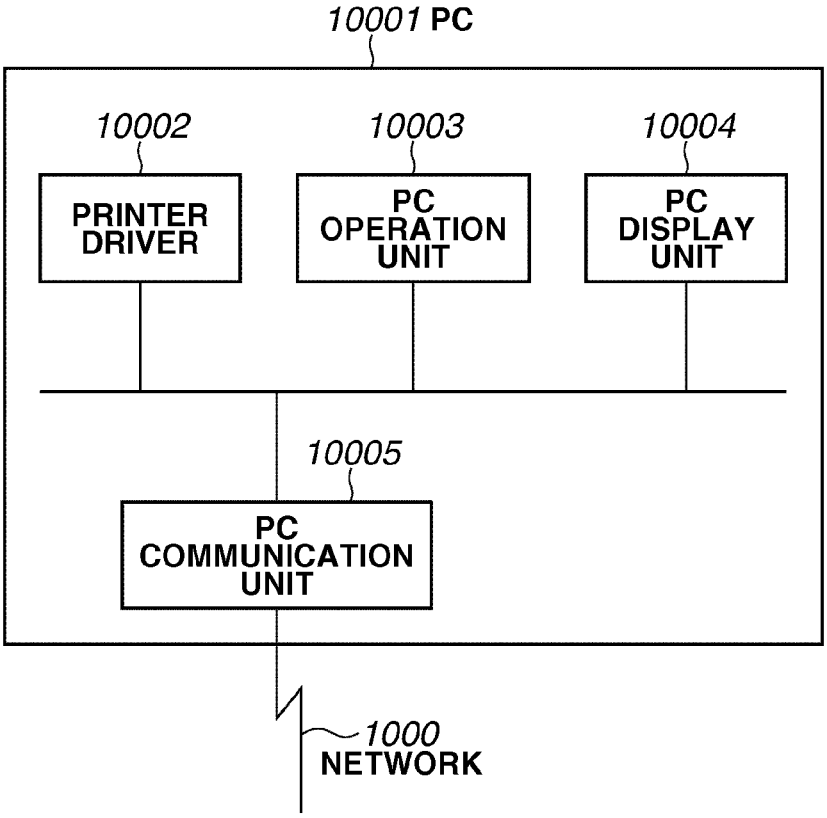
FIG. 10 is a block diagram illustrating a configuration of an information processing apparatus according to an exemplary embodiment.

FIG. 10 is a block diagram illustrating a configuration of the information processing apparatus according to the present exemplary embodiment. The example illustrates an example of constituting the information processing apparatus with a PC 10001.

In FIG. 10, it is assumed that in the PC 10001, a printer driver 10002 (not illustrated here) corresponding to the image forming apparatus 1 is already installed. A PC operation unit 10003 receives an operation of a printer driver setting screen 12001 (described below) by a user, and performs job setting relating to the print. A PC display unit 10004 displays the printer driver setting screen 12001. The printer driver 10002 transmits the print job to the image forming apparatus 1 via a PC communication unit 10005.

Figure 11:
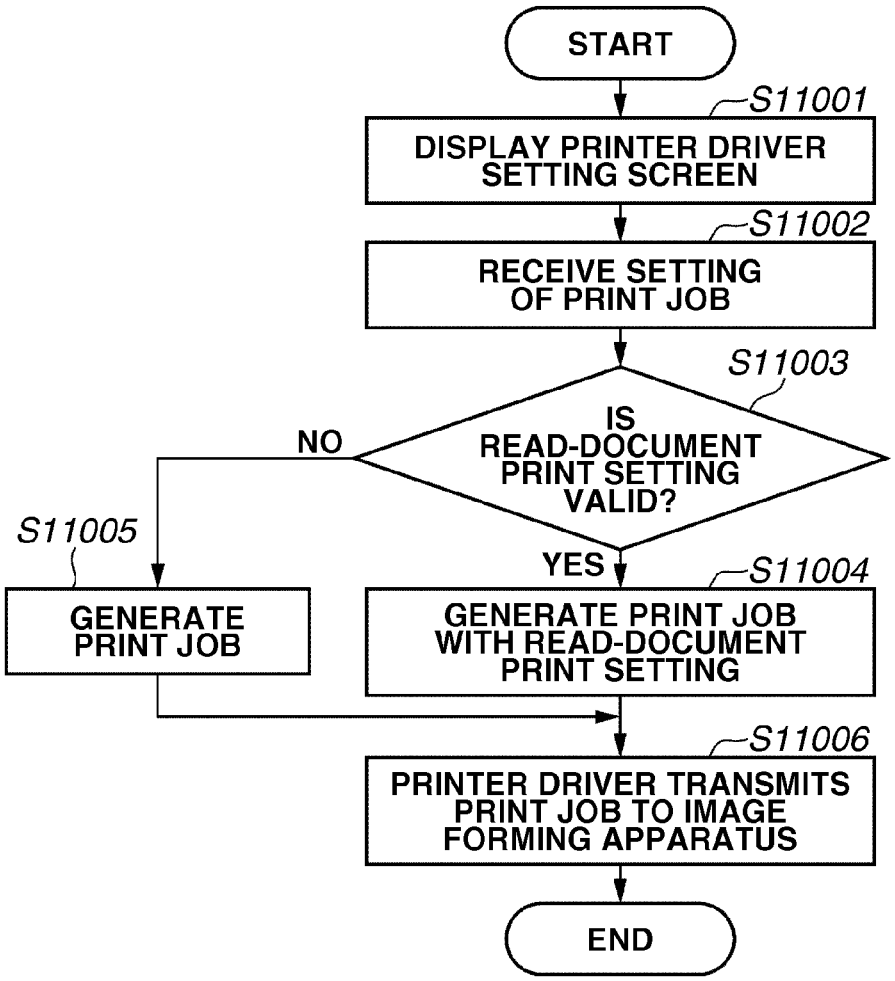
FIG. 11 is a flowchart illustrating a control method for the information processing apparatus according to an exemplary embodiment.

FIG. 11 is a flowchart illustrating a control method for the information processing apparatus according to the present exemplary embodiment. The example is a processing example in which the PC 10001 sends a print job to the image forming apparatus 1. Respective steps are realized by the CPU of the information processing apparatus executing the printer driver 10002.

Figure 12:
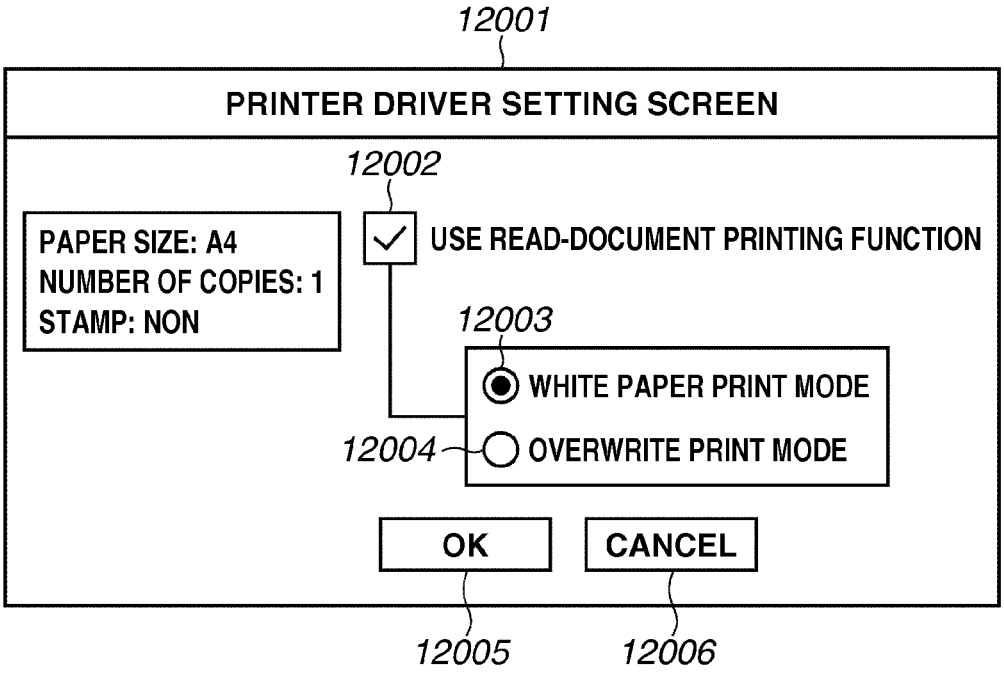
FIG. 12 illustrates an example of a user interface (UI) screen displayed on a PC display unit illustrated in FIG. 10.

FIG. 12 illustrates an example of a user interface screen displayed on the PC display unit 10004 illustrated in FIG. 10. The example illustrates an example of a printer driver setting screen displayed on the PC display unit 10004 by the printer driver 10002.

In step S11001, the PC operation unit 10003 receives an instruction of display of the printer driver setting screen 12001 from the user, and displays the printer driver setting screen 12001 on the PC display unit 10004. The printer driver setting screen 12001 enables setting relating to the print job.

In the present exemplary embodiment, a process in which the image forming apparatus receives a print job, reads a sheet in the sheet feeding unit before the start of printing, and subsequently prints on the sheet is referred to as a "read-document print function".

Further, setting to indicate whether the read-document print function is valid or invalid is referred to as "read-document print setting". In the read-document print setting in the present exemplary embodiment, two modes are included. The first mode is a mode in which the user instructs printing on a surface which is found to be white paper, which is referred to as a "white paper print mode (back surface print mode)". The second mode is a mode in which the user instructs printing on a surface which has been printed in advance, which is referred to as an "overwrite print mode".

Either of the white paper print mode and the overwrite print mode is to be assuredly set, when the read-document print setting becomes valid. Further, the two modes are controlled so that both cannot be made valid at one time. It is configured such that settings relating to printing such as the read-document print setting described above, sheet size, and number of copies can be performed from the printer driver setting screen 12001 illustrated in FIG. 12.

In step S11002, the PC operation unit 10003 receives an operation of the printer driver setting screen 12001 by a user, and performs setting relating to a print job. When the user wants to set the read-document print setting, the user selects a read-document print setting check box 12002 in the printer driver setting screen 12001 from the PC operation unit 10003, and checks the check box. When the read-document print setting check box 12002 is checked off, either of a white paper print mode setting button 12003 and an overwrite print mode setting button 12004 is displayed settably. In other words, it is configured such that the user can select nothing but either button of the white paper print mode setting button 12003 or the overwrite print mode setting button 12004. A cancel button 12006 is used to cancel the setting.

On a display screen illustrated in FIG. 12, there is displayed an example in which, when the user currently checks the read-document print setting check box 12002, the read-document print function becomes valid, and the white paper print mode setting button 12003 is selected. After the setting is completed, the user presses an OK button serving as a print job setting completion button 12005.

On the printer driver setting screen 12001 according to the present exemplary embodiment, settings relating to printing such as sheet size and number of copies, and print color, in addition to use or nonuse of the read-document print setting, are enabled. In the present exemplary embodiment, these are collectively referred to as print setting.

In the present exemplary embodiment, the read-document print setting assumes that even for a print job which includes a plurality of pages as image data, one setting is made for the whole print job, but the present exemplary embodiment is not limited to this. That is, the read-document print setting may be set for each page of the print job.

Next, in step S11003, the printer driver 10002 acquires presence or absence of a check mark of the read-document print setting check box 12002, and determines whether the read-document print setting is valid. If the printer driver 10002 determines that the read-document print setting check box 12002 is valid (YES in step S11003), then in step S11004, the printer driver 10002 adds a read-document print setting to the print setting, and generates a print job. Then, the processing proceeds to step S11006.

On the other hand, if the printer driver 10002 determines that the read-document print setting check box 12002 is not valid (NO in step S11003), then in step S11005, the printer driver 10002 generates a print job without adding the read-document print setting. Then, the processing proceeds to step S11006.

In step S11006, the printer driver 10002 transmits the print job to the image forming apparatus 1 via the PC communication unit 10005.

The above is descriptions of a flow of the processing in which a user sends a print job with a password from the printer driver 10002 in the PC 10001.

Next, print processing by the image forming apparatus 1 according to the present exemplary embodiment will be described with reference to FIG. 8 and FIG. 13.

Figure 13:
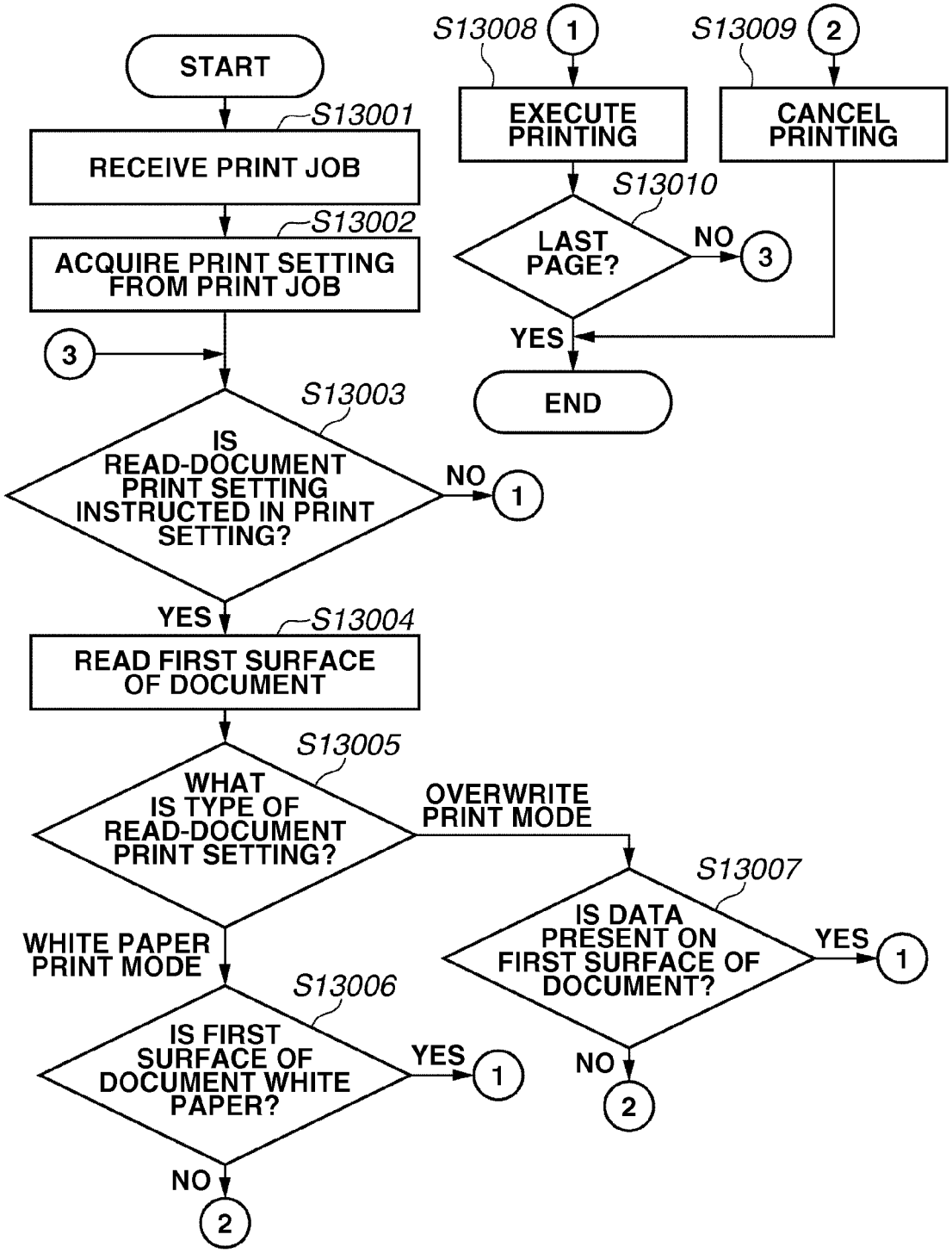
FIG. 13 is a flowchart illustrating a control method for the image forming apparatus according to an exemplary embodiment.

FIG. 13 is a flowchart illustrating a control method for the image forming apparatus according to the present exemplary embodiment. Programs corresponding to respective steps are stored in either storage unit of the program memory 803, or an SRAM 860, and are realized by the CPU 801 executing the stored programs. In the descriptions below, the CPU 801, the ASIC 802, the program memory 803, and the SRAM 860 in the image forming apparatus 1 are collectively referred to as a control unit 5, and a print control operation of the present exemplary embodiment will be described, taking the CPU 801 in the controller 800 as a control nucleus.

In step S13001, the CPU 801 receives from a network interface 850 a print job transmitted from the PC communication unit 10005, and stores the received print job in the image memory 804.

In step S13002, the CPU 801 acquires print setting of the received print job. Next, in step S13003, the CPU 801 determines whether "read-document print setting" is instructed in the acquired print setting.

If the CPU 801 determines that the read-document print setting is not instructed in the acquired print setting (NO in step S13003), then in step S13008, the CPU 801 executes printing on a current page of the print job. Then, the processing proceeds to step S13010. If the CPU 801 determines that the read-document print setting is instructed in the acquired print setting (YES in step S13003), the processing proceeds to step S13004.

In step S13004, the CPU 801 executes reading at the image reading unit 100, on a surface targeted for printing of a sheet stored in the first sheet feeding unit 30 illustrated in FIG. 1. Image data of the sheet read at that time (first surface sheet) is retained in the image memory 804, and is managed by the CPU 801.

Next, in step S13005, the CPU 801 determines whether the read-document print setting of the print setting acquired in step S13002 is "white paper print mode" or "overwrite print mode". If the CPU 801 determines that the read-document print setting of the print job is "white paper print mode" (WHITE PAPER PRINT MODE in step S13005), the processing proceeds to step S13006. If the CPU 801 determines that the read-document print setting of the print job is "overwrite print mode" (OVERWRITE PRINT MODE in step S13005), the processing proceeds to step S13007.

In step S13006, the CPU 801 determines whether image data of the surface (first surface) of the sheet targeted for printing stored in the image memory 804 is white paper (white paper image data). In the present exemplary embodiment, as a method in which the CPU 801 determines whether image data is white paper, there is used a method for regarding as white paper, if pixel information to be printed contains only pixel information equal to or less than a predetermined threshold value, for example, equal to or less than 1% of the total number of pixels in read pixel data, but the method is not especially limited. Different values or methods such as, for example, equal to or less than 5% as threshold value may be used. Consequently, it becomes possible to discriminate even a document in which a minute amount of dust or dirt adheres to a document reading surface as white paper.

If the CPU 801 determines that the image data is white paper (YES in step S13006), then in step S13008, the CPU 801 executes printing of the current page of the print job. Then, the processing proceeds to step S13010.

On the other hand, if the CPU 801 determines that the image data is not white paper (NO in step S13006), then in step S13009, the CPU 801 cancels printing of the current page of the print job. Then, the print processing ends.

By the processing in step S13006, in a case where the user instructs execution of the print job in the white paper print mode, it is possible to prevent execution of printing on a surface which is not white paper, of the sheet fed from the first sheet feeding unit 30.

On the other hand, in step S13007, the CPU 801 determines whether image data is present on a surface (first surface) of the sheet targeted for printing. In the present exemplary embodiment, as a method in which the CPU 801 determines presence of the image data, it is determined whether pixel information which should be printed is present not less than a certain threshold value, for example not less than 1% of the total number of pixels in the read pixel information, but it is not especially limited.

Different values or techniques may be used, such as for example, a case where the threshold value is set to not less than 5%, or a case of determining depending on whether pixel information is present in a predefined area of the sheet.

If the CPU 801 determines that image data is present (YES in step S13007), then in step S13008, the CPU 801 executes printing of the current page of the print job. Then, the processing proceeds to step S13010.

On the other hand, the CPU 801 determines that image data is not present (NO in step S13007), then in step S13009, the CPU 801 cancels printing of the current page of the print job. Then, the print processing ends.

By the processing in step S13007, if the user instructs execution of the print job in the overwrite print mode, it is possible to prevent execution of printing on a surface of white paper, of the sheet fed from the first sheet feeding unit 30.

In step S13010, the CPU 801 determines whether the current page of the print job is the last page. If the CPU 801 determines that the current page of the print job is not the last page (NO in step S13010), the processing proceeds to step S13003.

On the other hand, if the CPU 801 determines that the current page of the print job is the last page (YES in step S13010), the CPU 801 ends the print processing.

In the present exemplary embodiment, in step S13009, the CPU 801 cancels the whole print job. This is because if apiece of unintended sheet is present in the first sheet feeding unit 30, it is assumed that subsequent sheets stored in the first sheet feeding unit 30 are unintended ones. However, determination whether to print the next page included in the print job may be performed, but it is not especially limited. In that case, after the processing in step S13009 is performed, the processing proceeds to step S13010.

The above is descriptions, in the image forming apparatus 1 capable of reading a sheet in the sheet feeding unit in advance before printing, and printing on the sheet, of the processing for switching between print execution and print cancelation depending on an instruction of the overwrite print mode or the white paper print mode from the user and image data of the surface of the read sheet.

By the processing described above, printing on a surface of the sheet fed from the first sheet feeding unit 30, which is a user's unintended surface, can be prevented, and prevention of generation of an unnecessary print product can be realized.

In the above-described first exemplary embodiment, if an instruction of "overwrite print mode" or "white paper print mode" from the user and a condition of image data of a surface of the read sheet do not match each other, printing is cancelled. However, in the case of a "back surface" of the read sheet, a case where the mode which has been instructed from the user and the condition of image data match each other is assumed. This includes, for example, a case where the sheet is loaded with the front side face-down and the back side face-up into the sheet feeding unit. In this case, by determining the presence or absence of image data even with respect to the back surface of the sheet and determining execution of printing or cancelation of printing, it is possible to increase cases where printing is enabled.

Further, in the first exemplary embodiment, it is assumed that the image forming apparatus can execute read-document print setting of any of the "overwrite print mode" and the "white paper print mode". However, there is a possibility of limiting executable read-document print setting from the beginning as an operation. In the case of intending to limit an operation of the image forming apparatus, reading of unnecessary sheets can be reduced, by limiting in advance the read-document print setting which can be instructed.

In a second exemplary embodiment, in addition to the processing by the image forming apparatus according to the first exemplary embodiment, a control operation in the case of reading a back surface of the sheet and determining whether printing is enabled, in a case where a condition of image data of a surface of the firstly read sheet does not match a mode instructed from the user will be described.

Furthermore, in the second exemplary embodiment, a control operation in the case capable of setting read-document print setting to be permitted, for the image forming apparatus, and switching whether to execute the overwrite print mode or the white paper print mode depending on the permitted read-document print setting will be described.

In the second exemplary embodiment, a control operation for print processing of a print job executed by the image forming apparatus 1 will be described in detail with reference to FIG. 8, FIG. 14, and FIG. 15. In the present exemplary embodiment, not-described portions such as a configuration of the image forming apparatus 1, reading and printing processing of sheets, and transmission processing of print jobs of the printer driver are similar to those in the first exemplary embodiment.

Figure 14:
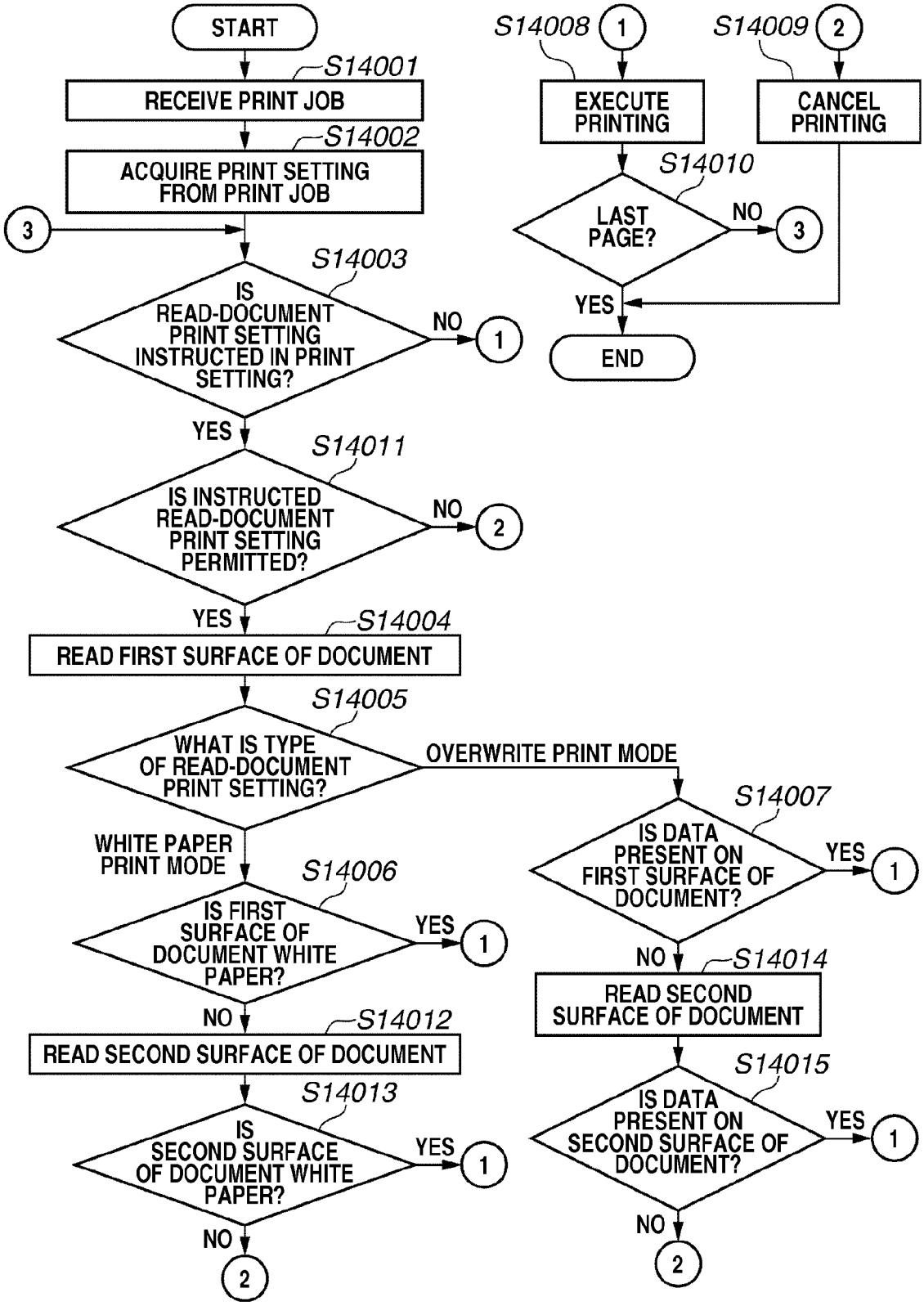
FIG. 14 is a flowchart illustrating a control method for the image forming apparatus according to an exemplary embodiment.

FIG. 14 is a flowchart illustrating a control method for the image forming apparatus according to the present exemplary embodiment. The programs corresponding to respective steps are stored in either storage unit of the program memory 803 or the SRAM 860, and are realized by the CPU 801 executing the stored programs. In the descriptions hereinbelow, the CPU 801, the ASIC 802, the program memory 803, and the SRAM 860 in the image forming apparatus 1 are collectively referred to as the CPU 801, and a print control operation of the present exemplary embodiment will be described taking the CPU 801 as a control nucleus. The processing illustrated in FIG. 14 is equivalent to addition of the processing in steps S140011 through S14015 to the processing illustrated in FIG. 13. The added processing operations are the ones relating to a control operation of switching the print processing depending on which read-document print setting the image forming apparatus permits, or a control operation of determining whether reading a back surface of the sheet matches a condition of the instructed read-document print setting, and the details thereof will be described below. Further, the processing operations in steps S14001 to S14010 in the flowchart illustrated in FIG. 14 are similar to the processing operations in steps S13001 to S13010 described in the flowchart of FIG. 13. Hereinbelow, in the present exemplary embodiment, portions pertaining to the processing operations different from the first exemplary embodiment will be described.

If the CPU 801 determines that read-document print setting is instructed in the acquired print setting (YES in step S14003), the processing proceeds to step S14011.

In step S14011, the CPU 801 acquires an operation setting retained in the SRAM 860 illustrated in FIG. 8, and determines whether the image forming apparatus 1 permits the read-document print setting of the print setting of the print job acquired in step S14002.

Figure 15:
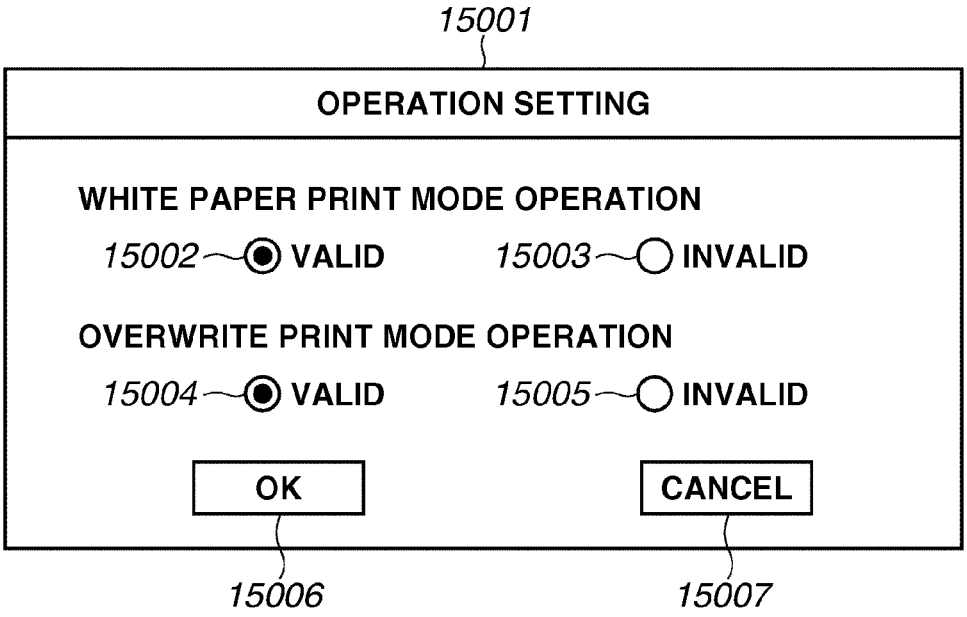
FIG. 15 illustrates an example of the UI screen displayed on the PC display unit illustrated in FIG. 10.

FIG. 15 illustrates an example of a user interface screen displayed on the PC display unit 10004 illustrated in FIG. 10. The example is an operation setting screen 15001 of the image forming apparatus 1 in the present exemplary embodiment. The read-document print function is a function of printing on a sheet in which an image was printed on the first surface or second surface of the sheet, which is stored in the first sheet feeding unit 30 and fed from the first sheet feeding unit 30.

The screen is provided by the CPU 801 via the network interface 850 as a service of a remote user interface (UI) arranged in the image forming apparatus 1, and is displayed by the PC display unit 10004. Further, the screen receives an operation by the PC operation unit 10003. Since the image forming apparatus 1 according to the present exemplary embodiment has a configuration of not providing a local UI such as a large liquid crystal screen, a remote UI is taken as an example, but it is not especially limited, and a control operation to enable displaying the screen on the image forming apparatus 1 side by providing the local UI may be performed.

In the operation setting screen 15001 illustrated in FIG. 15, whether the image forming apparatus 1 permits a print job for which the "white paper print mode" has been instructed can be set by a white paper print mode operation valid button 15002 or a white paper print mode operation invalid button 15003. Further, it is configured such that whether the image forming apparatus 1 permits a print job for which the overwrite print mode has been instructed can be set by an overwrite print mode operation valid button 15004 or an overwrite print mode operation invalid button 15005. A value set by the user using the screen is transmitted to the CPU 801 via the network interface 850 from the PC communication unit 10005, and is retained in the SRAM 860. In order to establish a content which the user has set on the operation setting screen 15001 and transmit the operation setting to the image forming apparatus 1, the user presses an OK button 15006. On the other hand, in order to cancel the operation setting, the user presses a cancel button 15007.

If the CPU 801 acquires the operation setting retained in the SRAM 860, and determines that the read-document print setting added to the print job is permitted (YES in step S14011), the processing proceeds to step S14004. If the CPU 801 acquires the operation setting retained in the SRAM 860, and determines that the read-document print setting added to the print job is not permitted (NO in step S14011), the processing proceeds to step S14009. In step S14009, the CPU 801 cancels printing and ends the print processing.

By the processing described above, reading of unnecessary sheets can be reduced by limiting unintended read-document print settings in advance by an administrator.

If the PC 10001 can acquire an operation setting of the image forming apparatus 1 at a transmission destination, display or operation of only read-document print setting permitted in advance may be enabled in the printer driver setting screen 12001.

If the CPU 801 determines that image data of a surface of a sheet targeted for printing is not white paper (NO in step S14006), then in step S14012, the CPU 801 executes reading a back surface (second surface) of the sheet read in step S14004 by the image reading unit 100. The image data of the sheet read at that time is also retained in the image memory 804 and is managed by the CPU 801.

Next, in step S14013, the CPU 801 determines whether image data of a surface (second surface) of the sheet read in step S14012 and stored in the image memory 804 is white paper. If the CPU 801 determines that the image data is not white paper (NO in step S14013), then in step S14009, the CPU 801 cancels printing of the current page of the print job.

On the other hand, if the CPU 801 determines that the image data is white paper (YES in step S14013), then in step S14008, the CPU 801 executes printing of the current page of the print job.

The user may instruct execution of the print job in the "white paper print mode" by the processing described above. In such a case, even when a surface (firstly read surface) of the sheet is not white paper, when a back surface (secondly read surface) of the sheet is white paper, it becomes possible to perform printing on the back surface.

Accordingly, it is possible to increase cases in which printing of the print data based on the print job on sheets set up in the first sheet feeding unit 30 and fed from the first sheet feeding unit 30 can be continued.

Further, if the CPU 801 determines that image data is not present on a surface of the sheet targeted for printing (NO in step S14007), then in step S14014, the CPU 801 executes reading by the image reading unit 100 on the back surface of the sheet read in step S14004.

Next, in step S14015, the CPU 801 determines whether image data is present on a surface (second surface) of the sheet read in step S14014. If the CPU 801 determines that the image data is not present (NO in step S14015), then in step S14009, the CPU 801 cancels printing of the current page of the print job.

On the other hand, if the CPU 801 determines that the image data is present (YES in step S14015), then in step S14008, the CPU 801 executes printing of the current page of the print job.

The user may instruct execution of the print job in the "overwrite print mode" by the processing described above. In such a case, even when image data is not present on a surface of the sheet, it becomes possible to perform printing when it is determined that image data is present on the back surface of the sheet.

Accordingly, it is possible to increase cases in which printing of print data based on a print job on sheets set up in the first sheet feeding unit 30 and fed from the first sheet feeding unit 30 can be continued.

The above is description of a control operation of reading a back surface of the sheet, and determining whether printing is enabled, in a case where a condition of image data of a surface of the firstly read sheet does not match an instruction from the user, and a control operation of switching execution of processing depending on the read-document print setting permitted by the image forming apparatus.

By a control operation of determining image data of a sheet even with respect to the back surface and determining execution or cancelation of printing, it is possible to increase cases in which printing is enabled when the user transmits a print job. Further, by the image forming apparatus by setting a read-document print setting to be permitted against a read-document print setting of the instructed print job, and by limiting an operation, reading of unnecessary sheets can be reduced.

A separate process in the case of performing reading of a document before printing the document and determining whether the read surface is not a preprinted surface or a preprinted surface will be described.

Figure 16:
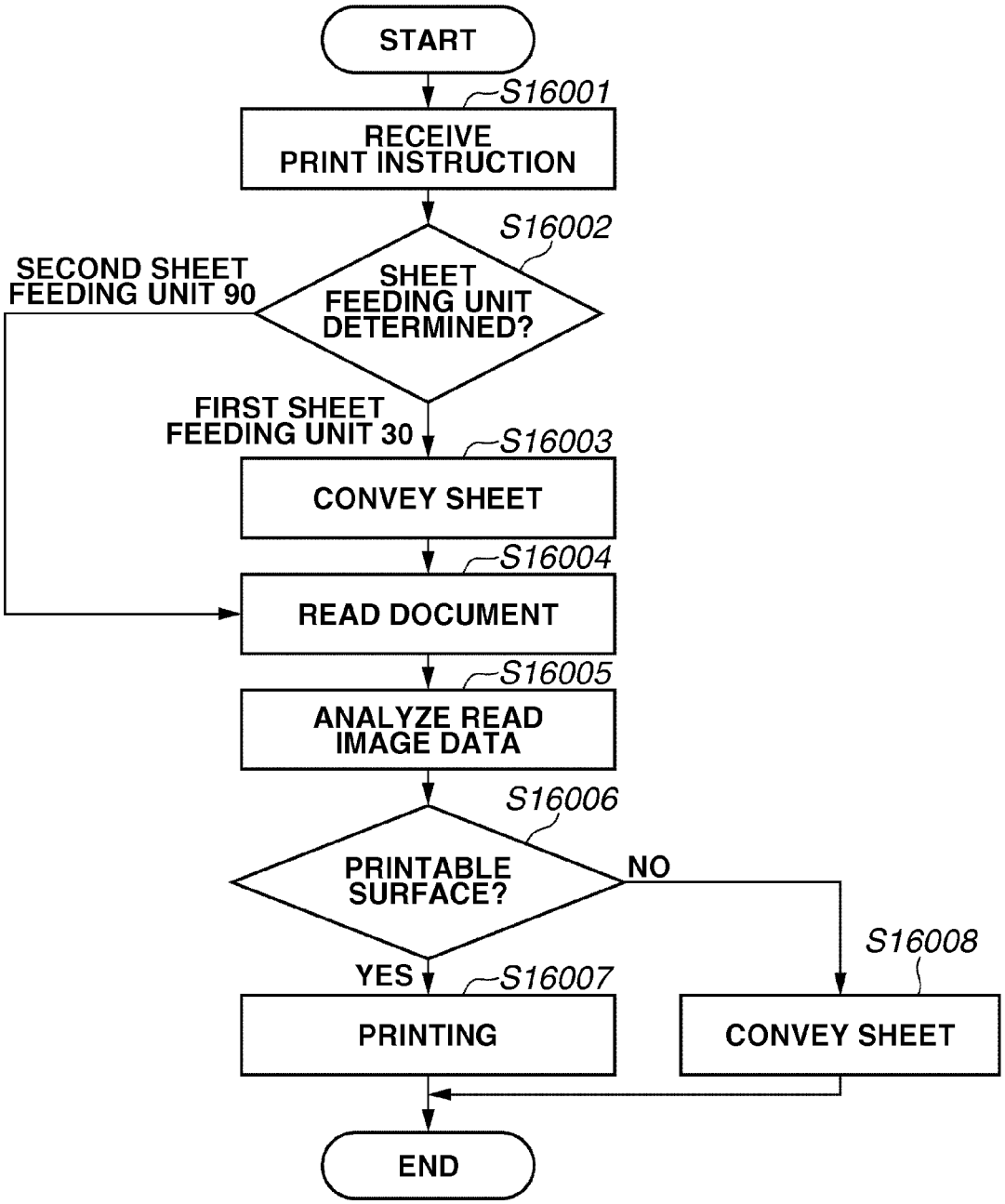
FIG. 16 is a flowchart illustrating a control method for the image forming apparatus according to an exemplary embodiment.

FIG. 16 is a flowchart illustrating a control method for an image forming apparatus according to a third exemplary embodiment. The example is a print processing example in a case where the back surface print mode has been set and reading of the first surface of the sheet is performed using the image reading unit 100 before printing on a sheet fed from the first sheet feeding unit 30, and it is determined whether the read surface is not a preprinted surface or a preprinted surface. In the present exemplary embodiment, the back surface print mode refers to a mode for printing on an unprinted back surface of the sheet (U-turn paper) already printed on one side of the sheet.

Respective steps are realized by the CPU 801 in the control unit 5 executing the control programs stored in the program memory 803. Hereinbelow, in the present exemplary embodiment, print control and conveyance control will be described in detail taking the CPU 801 as a control nucleus.

In step S16001, the CPU 801 receives a print signal (print instruction) from the information processing apparatus 10001 via the network interface 850.

In step S16002, the CPU 801 determines whether setting of the sheet feeding unit that feeds a sheet is the first sheet feeding unit 30 or the second sheet feeding unit 90, while referring to setting information stored in the program memory 803. Setting of the sheet feeding unit is to be set by an operation unit (not illustrated), or is to be set from the information processing apparatus 10001 using the network interface 850.

If the CPU 801 determines that it is a setting in which a sheet is fed from the first sheet feeding unit 30 (FIRST SHEET FEEDING UNIT 30 in step S16002), the processing proceeds to step S16003. On the other hand, if the CPU 801 determines that a sheet is fed from the second sheet feeding unit 90 (SECOND SHEET FEEDING UNIT 90 in step S16002), the CIS pickup roller 91 and the separation unit 92 convey a sheet stored in the second sheet feeding unit 90 to the conveyance roller pair 41 according to an instruction from the CPU 801, and the CPU 801 advances the processing to step S16004.

In step S16003, the CST pickup roller 31 and the separation unit 32 convey the recording material S stored in the first sheet feeding unit 30 one sheet by one sheet to the conveyance roller pair 40 according to an instruction from the CPU 801. The conveyance roller pair 40 conveys the sheet to the transfer unit 15. In the transfer unit 15, an image is transferred onto the conveyed sheet by driving of the transfer roller, and subsequently the sheet is conveyed to the fixing unit 50. Furthermore, in the fixing unit 50, the sheet on which heat fixing processing has been performed is conveyed to the sheet discharge roller 60 by driving of the fixing roller.

After the trailing edge of the sheet has passed through the two-sided flapper 61, the two-sided flapper 61 switches the conveyance path to the two-sided conveyance path side according to an instruction of the CPU 801. Thereafter, the sheet discharge roller 60 reversely rotates according to the instruction of the CPU 80, and conveys the sheet to the conveyance roller pair 41 via a conveyance path different from a fixing path. Then, the sheet will be further conveyed to the two-sided conveyance path 80.

In step S16004, the image reading unit 100 while facing the two-sided conveyance path 80 as described in FIG. 3, according to the instruction from the CPU 801, reads a first surface of the sheet. At that time, the CPU 801 causes the read image data to be stored in the image memory 804.

Next, the sheet, which has passed through the image reading unit 100, is conveyed to the conveyance roller pair 42. The conveyance roller pair 42 stops at a time point when the trailing edge of the sheet has passed through the switchback flapper 82. Therefore, the sheet stops while being nipped between the conveyance roller pair 42.

In step S16005, the CPU 801 analyzes image data stored in the image memory 804 in previous step S16004, and performs processing for determining whether the first surface of the sheet is a printed surface (preprinted surface).

Specifically, the CPU 801 binarizes the image data stored in the image memory 804 in step S16004. Then, the CPU 801 scans the binarized image data, and determines whether pixels of which pixel value is not "0" are included. If the CPU 801 determines that pixels of which pixel values are not "0" are contained, it is determined as a preprinted surface (preprinted surface). On the other hand, if the pixel values are all "0", it is determined as not a preprinted surface. A control operation may be performed to set a predetermined threshold value for determination reference thereof, and determine whether it is a preprinted surface.

In step S16006, the CPU 801 determines whether the first surface of the read sheet is a printable surface. If the CPU 801 determines that the first surface of the read sheet is not a preprinted surface, it is determined that the first surface of the read sheet is a printable surface. If the CPU 801 determines that the first surface of the read sheet is a "printable surface" (YES in step S16006), the processing proceeds to step S16007. If the CPU 801 determines that is not a "printable surface", the processing proceeds to step SS16008. In a case where the overwrite mode is set, a determination result in step S16006 become reverse. If the CPU 801 determines that the first surface of the read sheet is a preprinted surface, it is determined that the first surface of the read sheet is a printable surface.

In step S16007, the CPU 801 controls the conveyance roller pair 42, and the conveyance roller pair 42 conveys a sheet while being nipped between the conveyance roller pair 42 in step S16004 to the conveyance roller pair 40. The conveyance roller pair 40 conveys the sheet to the transfer unit 15, so as to synchronize timing (registration timing) of the toner image on the surface of the photosensitive drum 10 with the leading edge position of sheet.

The toner image conveyed to the transfer unit 15 by the rotation of the photosensitive drum 10 is transferred onto the sheet by an applied bias and pressure exerted to the transfer unit 15.

Furthermore, the transfer unit 15 conveys the sheet to the fixing unit 50. In the fixing unit 50, heat from the rotatable heating roller 51 and pressure of the rotatable pressure roller 52 located opposite the heating roller 51 cause the toner image to be fixed on the sheet. The sheet on which the toner image has been fixed is conveyed to the sheet discharge roller 60. The sheet discharge roller 60 conveys the sheet directly to the outside of the apparatus, and the sheet is stacked on the first sheet discharge unit 70.

At that time, the two-sided printing process described in FIG. 2 may be executed on the sheet conveyed to the sheet discharge roller 60, and an image which reveals to be a back surface may be printed on the second surface different from the first surface of the read sheet. The image which reveals to be the back surface is supposed to be stored in advance in the program memory 803. Furthermore, a position at which the image is printed may be also controlled to print it at a position having less influence on a printable surface or at a position to which the user sets. Alternatively, as a print report, a control operation may be performed to print it after discharging a sheet which should be printed at the end.

If it is determined that the first surface of the read sheet is not a printable surface, the CPU 801 controls the conveyance roller pair 42, and the conveyance roller pair 42 conveys a sheet while being nipped between the conveyance roller pair 42 to the conveyance roller pair 40. The conveyance roller pair 40 conveys the sheet to the transfer unit 15. At that time, transferring an image onto the sheet is not executed. Then, the transfer unit 15 conveys the sheet to the fixing unit 50. Furthermore, the fixing unit 50 conveys the sheet to the sheet discharge roller 60. The sheet discharge roller 60 conveys the sheet directly to the outside of the apparatus, and the sheet is stacked on the first sheet discharge unit 70. When a plurality of pages is printed, it is only necessary to repeat the processing in steps S16002 through S16008 by separately adding the processing for determining whether the sheet is the last page.

As described above, by the configuration of the present exemplary embodiment, in a case where the back surface print mode is set, even when the user has mistakenly stored sheets wrong (back) side in the first sheet feeding unit 30, it becomes possible to print an image only on a printable surface of the U-turn paper. Further, it also becomes possible to print an image which reveals to be a back surface, on a preprinted surface of the U-turn paper, it is convenient that the user can easily find out which of two-sides of the sheet is the front surface.

In a third exemplary embodiment, in a case where a preprinted surface of the U-turn paper is read, the U-turn paper will be directly discharged, and, accordingly, printing will not be executed on a printable surface. Further, in a case where the sheets stored in the sheet feeding tray are not actually U-turn paper, but two sides of the sheets are printable surfaces, an image which reveals to be a back surface may be printed in some cases on the second surface of the sheet, after the first surface of the sheet has been printed.

Figure 17:
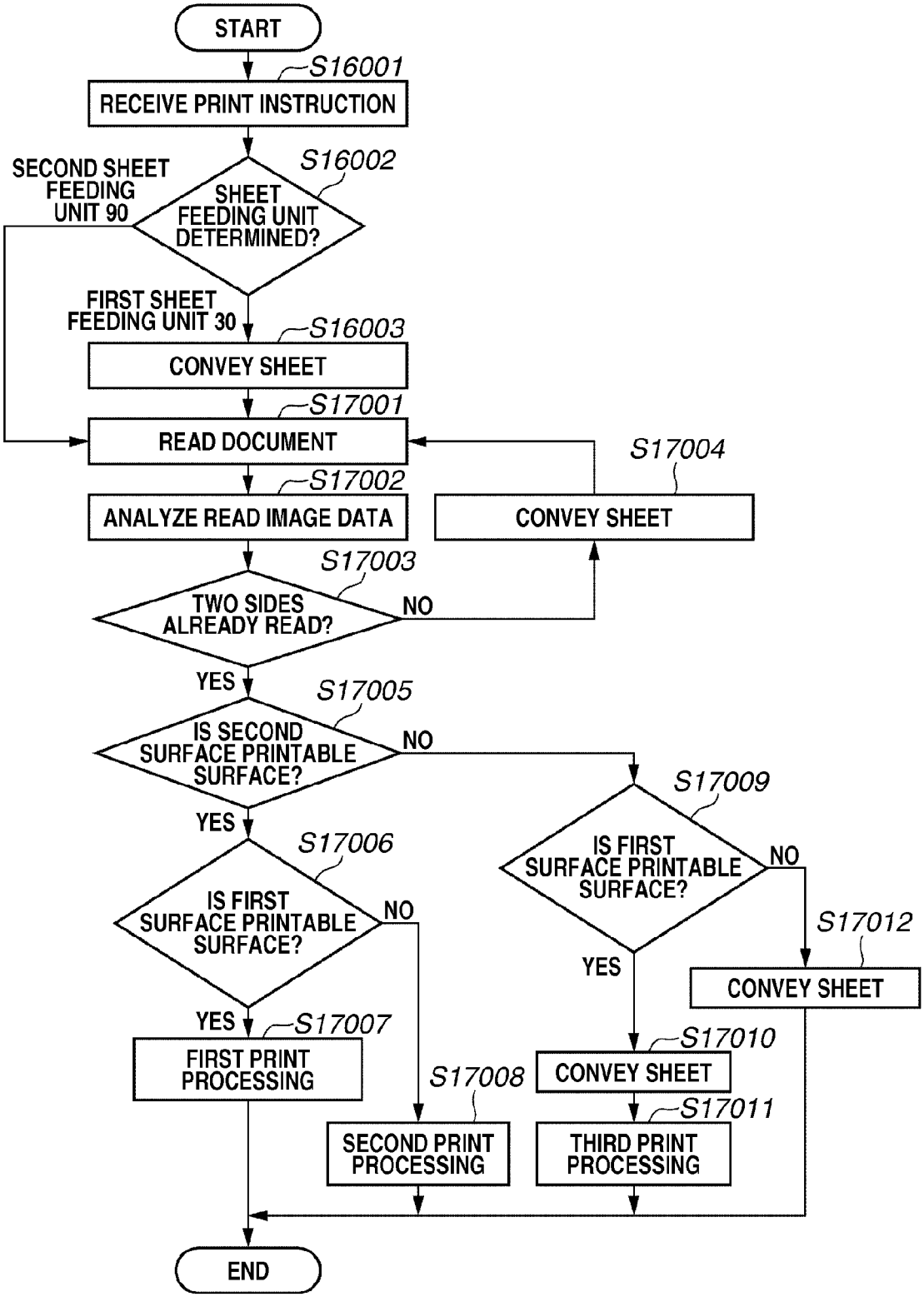
FIG. 17 is a flowchart illustrating a control method for the image forming apparatus according to an exemplary embodiment.

FIG. 17 is a flowchart illustrating a control method for an image forming apparatus according to a fourth exemplary embodiment as disclosed herein. The example is a print processing example in the case of, before printing a fed sheet, reading the sheet in the image reading unit 100 and determining whether the read surface is a not-yet-printed surface or a already printed surface. Respective steps are realized by the CPU 801 in the control unit 5 by executing the control programs stored in the program memory 803. Further, step S16001 through S16003 in FIG. 17 are similar to steps S16001 through S16003 in FIG. 16, and, therefore, descriptions of the corresponding steps will not be repeated. The program memory 803 is supposed to be constituted with a writable memory. Hereinbelow, in the present exemplary embodiment, print control and conveyance control will be described in detail taking the CPU 801 in the control unit 5 as a control nucleus.

In step S17001, the image reading unit 100 reads one side of the sheet in accordance with the process described in FIG. 3, according to an instruction from the CPU 801. At that time, in a case where the CPU 801 determines that read-surface information is not retained while referring to the program memory 803, the CPU 801 determines that the read surface is the first surface. When the CPU 180 determines that the read surface is the first surface, the CPU 180 stores the read-surface information indicating the first surface in the program memory 803. Further, if the CPU 801 determines that the read-surface information indicating the first surface is retained, while referring to the program memory 803, the CPU 801 determines that the read surface is the second surface. When the CPU 180 determines that the read surface is the second surface, the CPU 180 stores the read-surface information indicating the second surface in the program memory 803. Further, a sheet which has passed through the image reading unit 100 is conveyed to the conveyance roller pair 42. The conveyance roller pair 42 stops at a time point when the trailing edge of the sheet has passed through the switchback flapper 82. Therefore, the sheet stops while being nipped between the conveyance roller pair 42.

In step S17002, the CPU 801 analyzes the image data stored in the image memory 804 in step S1101, and performs processing for determining whether the read surface is a printed surface (preprinted surface). Specifically, the CPU 801 binarizes the image data stored in the image memory 804 in step S17001. The CPU 801 scans the binarized image data, and determines whether pixels of which pixel values are not "0" are contained. If the CPU 801 determines that pixels of which pixel values are not "0" are contained, it is determined that the read surface is a preprinted surface. Then, if the CPU 801 determines that the pixel values are all "0", the CPU 801 determines that the read surface is not a preprinted surface. The CPU 801 determines whether a surface of the read sheet is a preprinted surface. If the CPU 801 determines that the surface of the read sheet is not a preprinted surface, the CPU 801 determines that the surface of the read sheet is a printable surface. The CPU 801 stores the read-surface information being recorded in the program memory 803 and a determination result of whether the surface of the read sheet is a printable surface in the program memory 803 as printable surface information. In a case where the overwrite mode is set, the determination result in step S17002 is reversed. The CPU 801, when determining the read surface as a preprinted surface, determines the read surface as a printable surface.

In step S17003, the CPU 801 determines whether reading of two sides of a sheet fed from the first sheet feeding unit 30 or the second sheet feeding unit 90 has been already finished. If the CPU 801 determines that reading of two sides of the sheet has not yet finished (NO in step S17003), the processing proceeds to step S17004. In other words, in a case where the read-surface information recorded in the program memory 803 indicates the first surface, the CPU 801 advances the processing to step S17004. If the CPU 801 determines that reading of two sides of the sheet fed from the first sheet feeding unit 30 or the second sheet feeding unit 90 has been finished (YES in step S17003), the CPU 801 deletes the read-surface information from the program memory 803, then the processing proceeds to step S17005. In other words, the CPU 801, in a case where the read-surface information recorded in the program memory 803 indicates the second surface, deletes the read-surface information from the program memory 803, then advances the processing to step S17005.

In step S17004, the CPU 801 drives the conveyance roller pair 42, and the conveyance roller pair 42 conveys a sheet while being nipped between the conveyance roller pair 42 to the conveyance roller pair 40. The conveyance roller pair 40 conveys the sheet to the transfer unit 15. The transfer unit 15 conveys the sheet to the fixing unit 50. Furthermore, the fixing unit 50 conveys the sheet to the sheet discharge roller 60. The two-sided flapper 61, after the trailing edge of the sheet has passed therethrough, switches the conveyance path. Thereafter, the sheet discharge roller 60 reversely rotates, and conveys the sheet to the conveyance roller pair 41.

In step S17005, the CPU 801 determines whether the second surface is a printable surface, while referring to the printable-surface information recorded in the program memory 803. If the CPU 801 determines that the second surface is a printable surface (YES in step S17005), the processing proceeds to step S17006. If the CPU 801 determines that the second surface is not a printable surface (NO in step S17005), the processing proceeds to step S17009.

In step S17006, the CPU 801 determines whether the first surface is a printable surface, while referring to the printable surface information recorded in the program memory 803. If the CPU 801 determines that the first surface is a printable surface (YES in step S17006), the processing proceeds to step S17007. On the other hand, if the CPU 801 determines that the first surface is not a printable surface (NOT in step S17006), the processing proceeds to step S17008.

If two sides of the sheet are printable surfaces (if two sides of the sheet are white paper), in step S17007, the CPU 801 executes first print processing. Specifically, the CPU 801 controls the conveyance roller pair 42, and the conveyance roller pair 42 conveys the sheet while being nipped between the conveyance roller pair 42 to the conveyance roller pair 40. The conveyance roller pair 40 conveys the sheet to the transfer unit 15, so as to synchronize timing of the toner image on the surface of the photosensitive drum 10 with the leading edge position of the sheet. The toner image conveyed to the transfer unit 15 by rotation of the photosensitive drum 10 is transferred onto the sheet by an applied bias and pressure exerted to the transfer unit 15. Furthermore, the transfer unit 15 conveys the sheet to the fixing unit 50.

In the fixing unit 50, heat from rotatable heating roller 51 and pressure of rotatable pressure roller 52 located opposite the heating roller 51 cause the toner image to be fixed onto the sheet. The sheet onto which the toner image has been fixed is conveyed to the sheet discharge roller 60. The sheet discharge roller 60 conveys the sheet directly to the outside of the apparatus, and the sheet is stacked in the first sheet discharge unit 70.

At that time, in a case where the print instruction is two-sided printing, the CPU 801 executes the two-sided printing process described in FIG. 2 on the sheet conveyed by the sheet discharge roller 60, and ends the processing.

If one side of the sheet is a printable and the second surface of the sheet is a printable surface, then in step S17008, the CPU 801 performs second print processing. Specifically, the CPU 801 performs the processing similar to that in step S17007.

In step S17009, the CPU 801 determines whether the first surface is a printable surface, while referring to the printable surface information recorded in the program memory 803. If the CPU 801 determines that the first surface is a printable surface (YES in step S17009), the processing proceeds to step S17010. If the CPU 801 determines that the first surface is not a printable surface (NO in step S17009), the processing proceeds to step S17012.

If one side of the sheet is printable and the second surface of the sheet is not a printable surface, in step S17011, the CPU 801 performs third print processing. Specifically, in the processing, it is necessary to reverse the sheet so that the toner image be transferred onto the printable surface. To this end, in step S17010, the CPU 801 controls the conveyance roller pair 42, and the conveyance roller pair 42 conveys the recording material S while being nipped between the conveyance roller pair 42 to the conveyance roller pair 40. The conveyance roller pair 40 conveys the sheet to the transfer unit 15. Then, the transfer unit 15 conveys the sheet to the fixing unit 50. Furthermore, the fixing unit 50 conveys the sheet to the sheet discharge roller 60. The two-sided flapper 61, after the trailing edge of the sheet has passed therethrough, switches the conveyance path. Thereafter, the sheet discharge roller 60 reversely rotates, and conveys the sheet to the conveyance roller pair 41.

At that time, with respect to a conveyed sheet, an image which reveals to be a back surface may be printed on the second surface of the sheet in accordance with procedure for printing process described in FIG. 1.

In step S17011, the switched back sheet is conveyed to the image reading unit 100 via the conveyance roller pair 41. Thereafter, the sheet is conveyed to the conveyance roller pairs 42 and 40, and is again conveyed to the transfer unit 15. Then, transfer and fixation of the toner image are performed on the sheet, the sheet is stacked on the first sheet discharge unit 70, and the processing ends.

In step S1112, the CPU 801 performs processing in a case where two sides of the sheet are not printable surfaces (unprintable). Specifically, the CPU 801 controls the conveyance roller pair 42, and the conveyance roller pair 42 conveys the sheet while being nipped between the conveyance roller pair 42 to the conveyance roller pair 40. The conveyance roller pair 40 conveys the sheet to the transfer unit 15. The transfer unit 15 conveys the sheet to the fixing unit 50. Furthermore, the fixing unit 50 conveys the sheet to the sheet discharge roller 60. The sheet discharge roller 60 conveys the sheet directly to the outside of the apparatus, stacks the sheet into the first sheet discharge unit 70, and the processing ends.

In a case where a plurality of pages are printed, it is only necessary to repeat the processing in steps S16002 through S17012 with addition of the processing for determining whether the processed page is the last page.

According to the present exemplary embodiment, even when the user has mistakenly stored the U-turn paper with wrong (back) side facing up into the first sheet feeding unit 30, it becomes possible to print an image on an unintended surface. Further, it becomes possible to print an image which reveals to be aback surface on an already printed surface of the U-turn paper, and it becomes easy to find out which of the two sides of the sheet is the front surface.

In a fifth exemplary embodiment, with an assumption that the U-turn paper is stored in the sheet feeding tray at the time of a print instruction by the user, an image forming apparatus that enables confirmation of whether to perform processing for printing an image on an unintended surface will be described.

Figure 18:
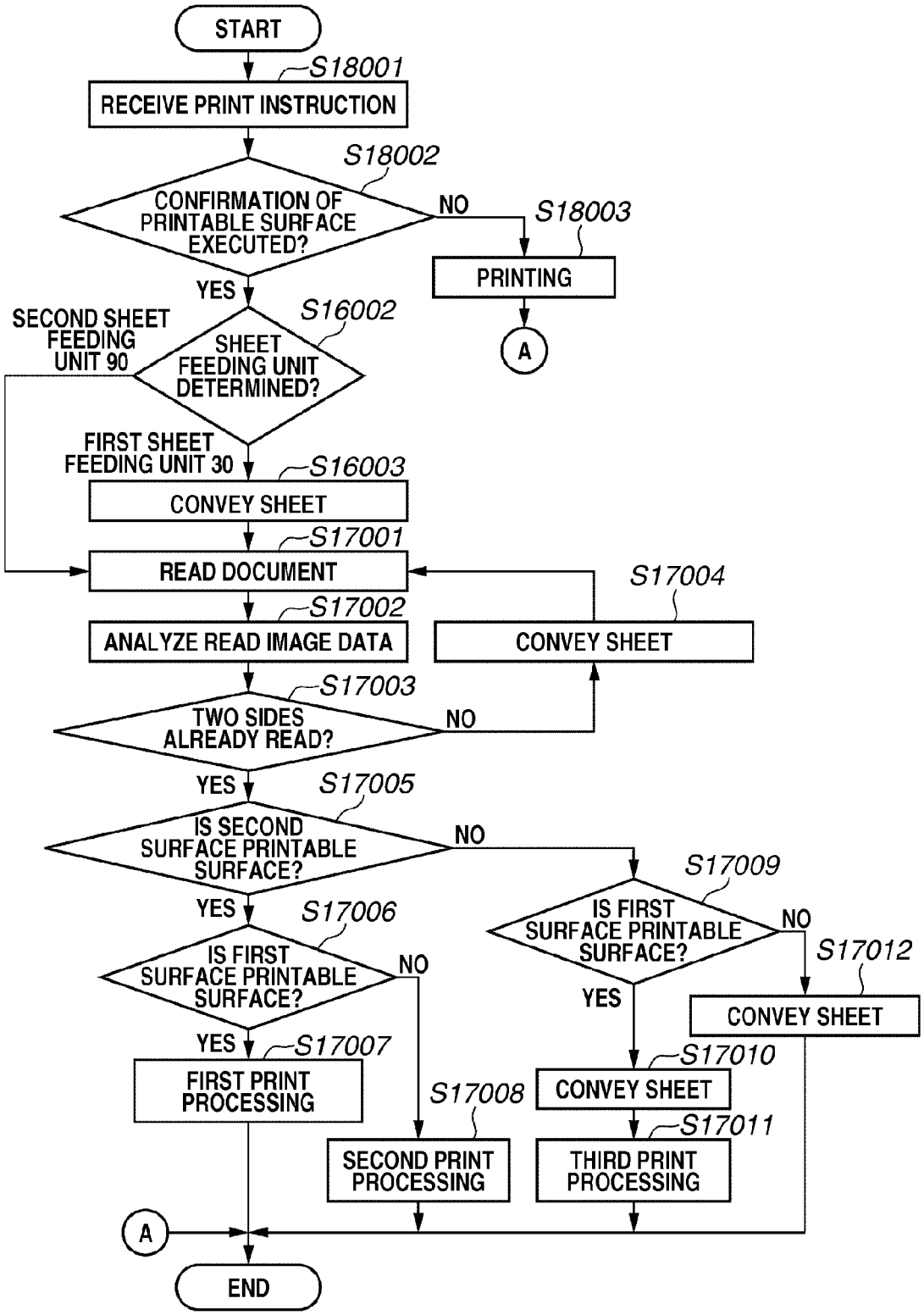
FIG. 18 is a flowchart illustrating a control method for the image forming apparatus according to an exemplary embodiment.

FIG. 18 is a flowchart illustrating a control method for an image forming apparatus according to a fifth exemplary embodiment. The example is a print processing example in the case of reading a sheet in the image reading unit 100 before printing the fed sheet, and determining whether the read surface is a not-yet-printed surface or an already printed surface. Respective steps are realized by the CPU 801 in the control unit 5 by executing a control program stored in the program memory 803. Further, steps S16002 and S16003 in FIG. 18 are similar to steps S16002 and S16003 in FIG. 16, and steps S17001 through S17012 in FIG. 18 are similar to steps S17001 through S17012 in FIG. 17, and, therefore, descriptions of the corresponding steps will not be repeated. The program memory 803 is assumed to be constituted with a writable memory. Hereinbelow, in the present exemplary embodiment, processing for limiting print execution based on print control taking the CPU 801 as a control nucleus and conveyance control will be described in detail. In the present exemplary embodiment, the CPU 801 performs processing for discriminating in step S1202 whether designation to perform reading which involves generation of printable surface information is made.

In step S18001, the CPU 801 receives a print signal, as described above. At that time, the print signal is transmitted to the image forming apparatus through a printer driver by the user operation from an information processing apparatus such as a PC.

In step S18002, the CPU 801 performs determination whether to perform confirmation processing of a printable surface. At that time, information which becomes determination reference may be stored as setting value information of the image forming apparatus in the program memory 803 in the image forming apparatus.

Further, the user may input an instruction of whether to perform confirmation processing of a printable surface at the time of the user operation from the information processing apparatus.

In this case, the information processing apparatus transmits an instruction content of the user together with the print signal to the image forming apparatus from, and the CPU 801 determines whether confirmation processing of a printable surface is to be performed based on the instruction content of the user. If the CPU 801 determines that confirmation processing of a printable surface is to be performed (YES in step S18002), the processing proceeds to step S16002. On the other hand, if the CPU 801 determines that confirmation processing of a printable surface not to be performed (NO in step S18002), the processing proceeds to step S18003.

In step S18003, the CPU 801 executes print processing described in FIG. 1. Further, in a case where the print instruction is two-sided printing, the CPU 801 executes the print processing described in FIG. 1, after executing the processing in FIG. 1.

According to the present exemplary embodiment, with an assumption that the U-turn paper be stored in the sheet feeding tray at the time of the print instruction by the user, it becomes possible to instruct whether to perform processing for printing an image on an unintended surface. This enables a reduction of a print waiting time of the user until the print product is output since the print instruction is issued, if it is not necessary to perform confirmation processing of a printable surface.

According to the respective exemplary embodiments, in a case where a preprinted sheet is fed and printing is performed on the sheet during the back surface print mode and a printing surface of the fed sheet is a preprinted surface, control can be performed not to execute printing on the printing surface of the fed sheet. Further, during the overwrite print mode, in a case where a printing surface of the fed sheet is not a preprinted surface, control can be performed not to execute printing on the printing surface of the fed sheet.

Embodiments of the present application can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2012-105609 filed May 7, 2012 and No. 2012-105610 filed May 7, 2012, which are hereby incorporated by reference herein in their entirety.

What is claimed is:

1. An image forming apparatus comprising:

a sheet storage unit configured to store a sheet;

a conveyance unit configured to convey the sheet using a two-sided conveyance path used for two-sided printing;

a printing unit configured to print an image on the sheet;

a setting unit configured to set a print setting for printing an image on a preprinted surface of a preprinted sheet conveyed from the sheet storage unit;

a reading unit configured to read a surface of the sheet conveyed using the two-sided conveyance path;

a determination unit configured to determine whether the surface read by the reading unit is a preprinted surface; and a print control unit configured, in a case where the print setting has been set and if it is determined that the surface read by the reading unit is a preprinted surface, to execute printing on the sheet conveyed using the two-sided conveyance path, and in a case where the print setting has been set and if it is determined that the surface read by the reading unit is not a preprinted surface, to restrict printing on the sheet conveyed using the two-sided conveyance path, wherein the setting unit sets at least one of the print setting for printing an image on a preprinted surface of a preprinted sheet conveyed from the sheet storage unit and another print setting for printing an image on an unprinted surface of a preprinted sheet conveyed from the sheet storage unit, and wherein the print control unit, in a case where the another print setting has been set and if it is determined that the surface read by the reading unit is a preprinted surface, restricts printing on the sheet conveyed using the two-sided conveyance path, and in a case where the another print setting has been set and if it is determined that the surface read by the reading unit is not a preprinted surface, executes printing on the sheet conveyed using the two-sided conveyance path.

2. The image forming apparatus according to claim 1, wherein the sheet storage unit stores a preprinted sheet on which an image was printed on a first surface or second surface thereof.

3. The image forming apparatus according to claim 1, wherein the reading unit reads an image of a conveyed document.

4. The image forming apparatus according to claim 1, wherein the printing unit prints an image on the sheet conveyed from the sheet storage unit based on image data of a document read by the reading unit.

5. An image forming apparatus comprising:

a sheet storage unit configured to store a sheet;

a conveyance unit configured to convey the sheet using a two-sided conveyance path used for two-sided printing;

a printing unit configured to print an image on the sheet;

a setting unit configured to set a print setting for printing an image on an unprinted surface of a preprinted sheet conveyed from the sheet storage unit;

a reading unit configured to read a surface of the sheet conveyed using the two-sided conveyance path;

a generation unit configured to determine whether respective surfaces read by the reading unit are preprinted or not preprinted and to generate printable surface information;

a retention unit configured to retain the printable surface information with respect to respective surfaces of the sheet generated by the generation unit; and a conveyance control unit configured, in a case where the print setting has been set, to control conveyance of the sheet so that the printing unit prints an image on an unprinted surface based on the printable surface information retained by the retention unit.

6. The image forming apparatus according to claim 5, further comprising a discrimination unit configured to discriminate whether designation to perform reading which involves generation of the printable surface information by the generation unit is made, wherein, in a case where the print setting has been set and if it is discriminated that designation to perform reading which involves generation of the printable surface information is made, the reading unit reads both surfaces of the sheet conveyed using the two-sided conveyance path.

7. The image forming apparatus according to claim 5, wherein the sheet storage unit stores a preprinted sheet on which an image was printed on a first surface or second surface thereof.

8. The image forming apparatus according to claim 5, wherein the reading unit reads an image of a conveyed document.

9. The image forming apparatus according to claim 5, wherein the printing unit prints an image on the sheet conveyed from the sheet storage unit based on image data of a document read by the reading unit.

10. An image forming apparatus comprising:

a sheet storage unit configured to store a sheet;

a printing unit configured to print an image on the sheet;

a setting unit configured to set a print setting for printing an image on a preprinted surface of a preprinted sheet conveyed from the sheet storage unit;

a reading unit configured to read a surface of the sheet conveyed from the sheet storage unit; and a control unit configured, in a case where the print setting has been set and if the surface read by the reading unit is a preprinted surface, to execute printing on the sheet, wherein the setting unit sets at least one of the print setting for printing an image on a preprinted surface of a preprinted sheet conveyed from the sheet storage unit and another print setting for printing an image on an unprinted surface of a preprinted sheet conveyed from the sheet storage unit, and wherein the control unit, in a case where the another print setting has been set and if the surface read by the reading unit is a preprinted surface, restricts printing on the sheet, and in a case where the another print setting has been set and if the surface read by the reading unit is not a preprinted surface, executes printing on the sheet.

11. A method for controlling an image forming apparatus including a sheet storage unit configured to store a sheet, and a printing unit configured to print an image on the sheet, the method comprising:

setting a print setting for printing an image on a preprinted surface of a preprinted sheet conveyed from the sheet storage unit;

reading a surface of the sheet conveyed from the sheet storage unit; and executing, in a case where the print setting has been set and if the read surface is a preprinted surface, printing on the sheet, wherein at least one of the print setting for printing an image on a preprinted surface of a preprinted sheet conveyed from the sheet storage unit and another print setting for printing an image on an unprinted surface of a preprinted sheet conveyed from the sheet storage unit can be set in the setting, and wherein, in a case where the another print setting has been set and if the read surface is a preprinted surface, printing on the sheet is restricted, and in a case where the another print setting has been set and if the read surface is not a preprinted surface, printing on the sheet is executed.

12. A non-transitory computer-readable storage medium storing a program that causes a computer to execute the method according to claim 11.

* * * * *